US008582994B2

(12) United States Patent
Karasawa

(10) Patent No.: US 8,582,994 B2
(45) Date of Patent: Nov. 12, 2013

(54) IMAGE FORMING SYSTEM FOR IMPROVED IMAGE FORMATION ON BOTH SIDES OF A RECORDING MEDIUM

(75) Inventor: Mitsuyuki Karasawa, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 231 days.

(21) Appl. No.: 13/176,348

(22) Filed: Jul. 5, 2011

(65) Prior Publication Data

US 2012/0014703 A1 Jan. 19, 2012

(30) Foreign Application Priority Data

Jul. 16, 2010 (JP) ..... 2010-161524
Oct. 29, 2010 (JP) ..... 2010-243322
May 31, 2011 (JP) ..... 2011-122364

(51) Int. Cl.
*G03G 15/00* (2006.01)

(52) U.S. Cl.
USPC ..... 399/49; 399/72

(58) Field of Classification Search
USPC ..... 399/49
See application file for complete search history.

(56) References Cited

U.S. PATENT DOCUMENTS

| | | | | |
|---|---|---|---|---|
| 6,941,083 | B1 * | 9/2005 | Muratani | 399/49 |
| 2006/0072939 | A1 * | 4/2006 | Kremer et al. | 399/130 |
| 2009/0034996 | A1 * | 2/2009 | Goto | 399/44 |
| 2010/0054772 | A1 * | 3/2010 | Kikuchi | 399/45 |

FOREIGN PATENT DOCUMENTS

| | | | |
|---|---|---|---|
| JP | 2-59525 | | 12/1990 |
| JP | 4-371970 | | 12/1992 |
| JP | 6-95474 | | 4/1994 |
| JP | 6-171156 | | 6/1994 |
| JP | 7-237336 | | 9/1995 |
| JP | 10020570 | A * | 1/1998 |
| JP | 11-65219 | | 3/1999 |
| JP | 2000-71522 | | 3/2000 |
| JP | 2002-187660 | | 7/2002 |
| JP | 3426485 | | 5/2003 |
| JP | 2004-62170 | | 2/2004 |
| JP | 2005-148127 | | 6/2005 |
| JP | 3688071 | | 6/2005 |
| JP | 2005-274919 | | 10/2005 |
| JP | 2006-276427 | | 10/2006 |
| JP | 2007-293047 | | 11/2007 |
| JP | 4598481 | | 10/2010 |
| JP | 4641399 | | 12/2010 |

* cited by examiner

*Primary Examiner* — David Gray
*Assistant Examiner* — Tyler Hardman
(74) *Attorney, Agent, or Firm* — Oblon, Spivak, McClelland, Maier & Neustadt, L.L.P.

(57) ABSTRACT

An image forming system including a first image forming apparatus and a second image forming apparatus. The first image forming apparatus forms an image on a first side of a recording medium and has a mark forming device to form a mark on the recording medium. The second image forming apparatus forms an image on a second side which is the obverse of the first side, and has a mark detector to detect the mark at a predetermined position in a conveyance path of the recording medium and a calculator to calculate an expansion and contraction ratio of the recording medium in a first direction and in a second direction perpendicular to the first direction based on the output of the mark detector.

15 Claims, 10 Drawing Sheets

(a)

(b)

IMAGE FORMING SYSTEM FOR IMPROVED IMAGE FORMATION ON BOTH SIDES OF A RECORDING MEDIUM

BACKGROUND OF THE INVENTION

1. Field of the Invention

The present invention relates to an image forming system that forms images on both sides of a recording medium using two image forming apparatuses.

2. Description of the Background

As an image forming system in which images are formed on both sides of a recording medium (typically paper), an image forming system having two printing apparatuses arranged in series along the conveyance path of the paper is known, as disclosed, for example, in Japanese patent application publication no. H07-237336(JP-H07-237336-A). In this image forming system, the first, upstream image forming apparatus forms an image on the first side of a long recording medium longer in the conveyance direction, the long recording medium discharged from the first image forming apparatus is reversed by a reversing device, and the second, downstream image forming apparatus forms an image on the second (reverse) side of the long recording medium.

In the image forming system described above, for example, if the first image forming apparatus forms images by electrophotography, the recording medium (e.g., paper) may expand or contract due to heating in the heat fixing process, in which the toner image transferred to the recording medium is melted and fixed on the recording medium.

When the recording medium expands or contracts, the length of the recording medium when it is fed into the second image forming apparatus changes from the original length so that the first page of the recording medium has a different length from the second page. Consequently, it can happen that the position of the image formed on the first side does not align with that on the second page.

In addition, when the first image forming apparatus forms images using the inkjet system, the recording medium may expand or contract due to heat applied thereto in the drying process after discharging ink to form an image on the recording medium. Therefore, if the first image forming apparatus forms images using the ink jet system, the same positioning problem arises as in the case in which the first image forming apparatus forms images by electrophotography.

To solve the problem described above, for example, JP-H07-237336-A describes an image forming system that aligns the image position on the first side of a recording medium and the image position on the second side thereof by forming alignment marks at predetermined positions (e.g., at the top of a page) on the recording medium with the first image forming apparatus, measuring the distance between the alignment marks or the detection timing thereof with the second image forming apparatus, and changing the conveyance speed of the recording medium based on the measuring result.

However, although the technologies described above are successful in that they do align the image positions along the conveyance direction of the recording medium (hereinafter referred to as the sub-scanning direction), they are not capable of making alignment of the image positions in the direction perpendicular to the recording medium (hereinafter referred to as the main scanning direction). That is, expansion and contraction of the recording medium caused by heating may occur not only in the sub-scanning direction but also in the main scanning direction depending on the type of paper. Herein, "different types of paper" means, for example, paper having different characteristics such as length of a page formed on the recording medium and the distance between the alignment marks on the recording medium, in addition to different dimensions such as the thickness and the width (length along the main scanning direction), the material, etc. of the recording medium. If the recording medium expands or contracts in the main scanning direction as well as the sub-scanning direction, the image positions of the first side and the second side of the recording medium are not aligned properly by the technologies described above.

SUMMARY OF THE INVENTION

In view of the foregoing, the present invention provides an image forming system including a first image forming apparatus to form an image on a first side of a recording medium, the first image forming apparatus including a mark forming device to form a mark having a first mark portion and a second mark portion on the recording medium, the first mark portion having a length variable in a first direction along the conveyance direction of the recording medium based on the position of the mark relative to a second direction perpendicular to the conveyance direction, the second mark portion having a line form parallel to one side of the first mark portion except for a side in parallel to the first direction, with a predetermined gap between the first mark portion and the second mark portion; a reversing device to reverse the recording medium; and a second image forming apparatus to form an image on the second side that is the obverse of the first side, the second image forming apparatus including a mark detector to detect the mark formed by the mark forming device of the first image forming apparatus at a predetermined position along the conveyance path of the recording medium while the mark passes through the predetermined position and output a first passing-through time, representing a time taken for the portion of the predetermined gap between the first mark portion and the second mark portion to pass through the mark detection position, and a second passing-through time, representing a time taken for the first mark portion to pass through the predetermined position, and a calculator to calculate an expansion and contraction ratio of the recording medium in the first direction and an expansion and contraction ratio of the recording medium in the second direction based on the first passing-through time and the second passing-through time output by the mark detector.

It is preferred that, in the image forming system mentioned above, the mark detector includes two detection portions to detect the mark at the predetermined position at two places which are different relative to the second direction and the calculator calculates the expansion and contraction ratio of the recording medium in the first direction, the expansion and contraction ratio of the recording medium in the second direction, and a meandering amount of the recording medium in the second based on the first passing-through time and the second passing-through time output by one of the two detection portions and the first passing-through time and the second passing-through time output by the other of the two detection portions.

It is still further preferred that the image forming system mentioned above further includes an image adjusting device to align the position of the image formed on the second side with the position of the image formed on the first side by adjusting the scaling factor of the image formed on the second side in the first direction based on the expansion and contraction ratio of the recording medium in the first direction and the scaling factor of the image formed on the second side in the second direction based on the expansion and contraction ratio of the recording medium in the second direction.

It is still further preferred that the image forming system mentioned above further includes a memory to store the first passing-through time obtained in a state in which the recording medium has no change in the length of the first direction as a reference time, wherein the calculator calculates the expansion and contraction ratio of the recording medium in the first direction as:

$$\alpha = ta/tb \quad \text{Relationship 1}$$

where $\alpha$ represents the expansion and contraction ratio of the recording medium in the first direction, ta represents the first passing-through time, and tb represents the reference time.

It is still further preferred that, in the image forming system mentioned above, the first mark portion is a right triangle having a first side extending in the first direction, the first side being one of two sides other than the hypotenuse of the right triangle, and the other side of the two sides extending in the second direction.

It is still further preferred that, in the image forming system mentioned above, the two places are situated so as to trisect the second side of the first mark portion, and the calculator calculates the expansion and contraction ratio of the recording medium in the second direction as:

$$\beta = (1/3) \times \{\alpha \times (m/v)\}/(td - tc) \quad \text{Relationship 2}$$

where $\beta$ represents the expansion and contraction ratio of the recording medium in the second direction, tc represents the second passing-through time output by one of the two detection portions, td represents the second passing-through time output by the other of the two detection portions, $\alpha$ represents the expansion and contraction ratio of the recording medium in the first direction, m represents a length of the first side of the first mark portion, and v represents a conveyance speed of the recording medium.

It is still further preferred that, in the image forming system mentioned above, the calculator calculates the meandering amount as:

$$S = R/3 \times [tc/(td - tc) - 1] \times \beta \quad \text{Relationship 3}$$

where S represents the meandering amount and R represents a length of the second side of the first mark portion.

It is still further preferred that, in the image forming system mentioned above, the meandering amount S is valid only when the meandering amount is equal to or less than a third of the length of the second side of the first mark portion.

It is still further preferred that, in the image forming system mentioned above, the mark forming device forms the mark at multiple places of the first side and the calculator determines an average of meandering amounts calculated for the mark formed at the multiple places as the meandering amount.

It is still further preferred that, in the image forming system mentioned above, the mark forming device forms the mark such that the second side of the first mark portion is arranged at the writing starting position of the image formed on the first side, and the second image forming apparatus adjusts the position of starting writing the image formed on the second side based on the timing of the mark detector detecting the second side of the first mark portion.

It is still further preferred that, in the image forming system mentioned above, the first image forming apparatus further includes a density detector to detect the density of the mark and the second image forming apparatus further includes a sensitivity adjustment device to adjust the sensitivity of the mark detector based on the density of the mark detected by the density detector.

It is still further preferred that, in the image forming system mentioned above, the mark forming device forms the mark by forming a toner image of the mark on an image bearing member, transferring the toner image to the first side, and melting and fixing the toner image thereon and the density detector detects the density of the toner image of the mark before the toner image is transferred to the first side.

It is still further preferred that, in the image forming system mentioned above, the mark forming device forms the mark by forming a toner image of the mark on an image bearing member, transferring the toner image to the first side, and melting and fixing the toner image thereon, and the density detector detects the density of the toner image of the mark after transferring of the toner image to the first side and before melting and fixing of the toner image thereon.

It is still further preferred that, in the image forming system mentioned above, the mark forming device forms the mark by forming a toner image of the mark on an image bearing member, transferring the toner image to the first side, and melting and fixing the toner image thereon, and the density detector detects the density of the toner image of the mark fixed on the first side.

It is still further preferred that the image forming system mentioned above further includes a density adjustment device to adjust the density of the mark based on the output of the mark detector.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Embodiments of the image forming system related to the present disclosure are described with reference to the accompanying drawings.

First Embodiment

Figure 1:
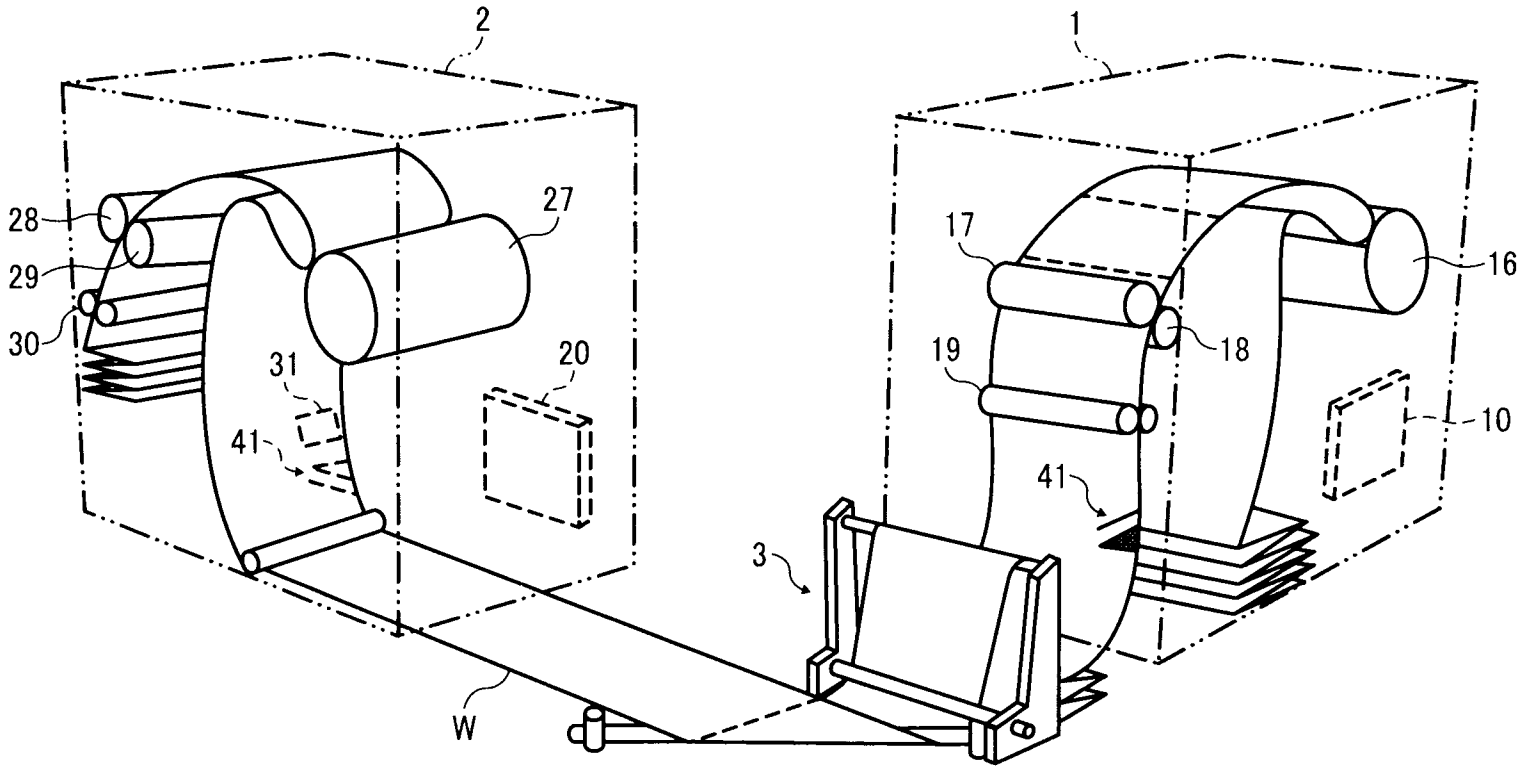
FIG. 1 is a diagram illustrating an example of the structure of a printing system of the present disclosure.

FIG. 1 is a diagram illustrating the printing system of the present embodiment. As illustrated in FIG. 1, this printing system has a first image forming apparatus 1 (first printing apparatus) and a second image forming apparatus (second printing apparatus) 2, functioning as two separate image forming apparatuses employing electrophotography, and a reversing device 3. The first printing apparatus 1 and the second printing apparatus 2 are arranged in series along the conveyance path of a roll of paper W. The first printing apparatus 1 is arranged on the upstream side and forms an image on the surface (hereinafter referred to as the first side) of the paper W being transferred. The second printing apparatus 2 is arranged on the downstream side and forms an image on the reverse surface (hereinafter referred to as the second side of the paper W) of the first side on which the image is formed by the first printing apparatus 1.

The conveyance path of the paper W has an L shape, having an almost perpendicular turn between the first printing apparatus 1 and the second printing apparatus 2.

The reversing device 3 is arranged between the first printing apparatus 1 and the second printing apparatus 2 and reverses the paper W. The printing system operates the first printing apparatus 1, the second printing apparatus 2, and the reversing device 3 in cooperation to form images on both sides of the long paper W.

Long paper has a continuous sheet form, a band form, or a continuous form divided, perforated, or folded by page. The printing system of the present disclosure uses any of these long paper types. Hereinafter, long paper for use in the printing system of the present disclosure is referred to as simply paper.

The first printing apparatus 1 is an image forming apparatus having printing capabilities of a printer, a photocopier, a multi-functional machine, etc. The first printing apparatus 1 has a control unit 10 and an image forming unit. The image forming unit of the first printing apparatus 1 has an image bearing member 16, devices provided around the image bearing member 16 such as a charging device, an irradiation device, a development device, a discharging device, a cleaning device, and a transfer device, a heating roller 17, a pressing roller 18, and a feeding roller 19. The image forming unit of the first printing apparatus 1 forms a toner image on the image bearing member 16 and transfers the toner image to the first side of the paper W transferred along the conveyance path to form the image on the paper W by the control of the control unit 10.

In addition to the image forming on the first side of the paper W, the image forming unit of the first printing apparatus 1 forms a mark 41 at a predetermined position on the first side of the paper W to calculate the ratio of expansion and contraction in the sub-scanning direction (first direction) of the paper W and the ratio of expansion and contraction in the main scanning direction (second direction) of the paper W with the control unit 10. The predetermined position indicates, for example, positions including the top of the page of the paper W with an equal gap between adjacent positions and a peripheral portion of the paper W parallel to the conveyance direction of the paper W.

The mark 41 includes a first mark portion 41*a* and a second mark portion 41*b*. The first mark portion 41*a*, which in this particular embodiment takes a generally triangular shape, has a length that changes depending on the position of the mark 41 in the main scanning direction. The second mark portion 41*b* is a line parallel to one of the sides (except the line parallel to the sub-scanning direction) of the first mark portion 41*a*, with a predetermined gap between the first mark portion 41*a* and the second mark portion 41*b*. A detailed description of specific examples of the mark 41 is deferred.

The image forming unit of the first printing apparatus 1 melts and fixes the toner image and the mark 41 on the first side of the paper W while conveying and nipping the paper W with a pair of the fixing rollers formed of the heating roller 17 and the pressing roller 18 which apply heat and pressure to the paper W. The image forming unit of the first printing apparatus 1 feeds the paper W on which the image and the mark 41 are formed on the first side to the reversing device 3 by the feeding roller 19.

The reversing device 3 turns the direction of the paper W discharged outside the first printing apparatus 1 with an angle close to a right angle, reverses the sides of the paper W, and feeds it to the second printing apparatus 2. Therefore, the paper W is sent out from the first printing apparatus 1 to the reversing device 3 with the first side of the paper W facing up on which the image and the mark 41 are formed by the first printing apparatus 1, and then the paper W is fed from the reversing device 3 to the second printing apparatus 2 with the second side facing up on which an image is to be formed by the second printing apparatus 2.

The second printing apparatus 2 has the printing capabilities of a printer, a photocopier, a multi-functional machine, etc. like the first printing apparatus 1.

The second printing apparatus 2 has a mark sensor 31 (i.e., a mark detector), a control unit 20, and an image forming unit. The image forming unit of the second printing apparatus 2 has an image bearing member 27, devices provided around the image bearing member 27 such as a charging device, an irradiation device, a development device, a discharging device, a cleaning device, and a transfer device , a heating roller 28, a pressing roller 29, and a feeding roller 30.

The mark sensor 31 is arranged at a predetermined position (hereinafter referred to as the mark detection position) on the upstream side of the image forming unit in the conveyance path of the paper W with the detection side opposing the first side of the paper W transferred in the conveyance path. The mark sensor 31 detects the mark 41 when the mark 41 formed on the first side of the paper W by the first printing apparatus 1 passes through the mark detection position while the paper W is being transferred.

The mark sensor 31 outputs a first passing-through time, representing a time taken for the portion of the predetermined gap between the first mark portion and the second mark portion of the mark 41 to pass through the mark detection position, and a second passing-through time, representing a time taken for the first mark portion of the mark 41 to pass through the mark detection position to the control unit 20.

The image forming unit of the second printing apparatus 2 forms an image by electrophotography on the second image of the paper W being transferred by the control of the control unit 20. The control unit 20 calculates the ratio of expansion and contraction in the sub-scanning direction and the ratio of expansion and contraction in the main scanning direction of the paper W based on the first passing-through time and the second passing-through time input from the mark sensor 31. The calculation method is specified later in detail.

The control unit 20 controls the image forming unit such that the position of the image formed on the second side of the paper W matches the position of the image formed on the first side of the paper W according to the calculated ratio of expansion and contraction in the sub-scanning direction and the calculated ratio of expansion and contraction in the main scanning direction.

To be specific, the control unit 20 adjusts the magnification ratio in the sub-scanning direction of the image formed on the second surface of the paper W by controlling the conveyance speed of the paper W based on the ratio of expansion and contraction in the sub-scanning direction of the paper W.

In addition, the control unit 20 adjusts the magnification ratio in the main scanning direction of the image formed on the second surface of the paper W by changing the dot gap of the image based on the ratio of expansion and contraction in the main scanning direction of the paper W. Moreover, the control unit 20 matches the position of the image formed on the second side of the paper W with the position of the image formed on the first side of the paper W by adjusting the image with regard to the sub-scanning direction and the main scanning direction based on the ratio of expansion and contraction in the sub-scanning direction and the ratio of expansion and contraction in the main scanning direction of the paper W.

In addition, the image forming unit of the second printing apparatus 2 melts and fixes the toner of the image on the second side of the paper W by conveying and nipping the paper W with the pair of the fixing rollers formed of the heating roller 28 and the pressing roller 29 that apply heat and pressure to the paper W. The image forming unit of the second printing apparatus 2 feeds the paper W on which the image is formed on the second side to a discharging tray provided inside the second printing apparatus 2 by the feeding roller 30.

Therefore, the paper W having the images printed on both sides by the first printing apparatus 1 and the second printing apparatus 2 is accumulated in the discharging tray of the second printing apparatus 2.

In the printing system related to this embodiment, the first printing apparatus 1 forms the mark 41 in addition to the image on the first side of the paper W. The second printing apparatus 2 detects the mark 41 formed on the first side of the paper W by the mark sensor 31 and calculates the ratio of expansion and contraction in the sub-scanning direction and the ratio of expansion and contraction in the main scanning direction. The second printing apparatus 2 forms an image on the second side of the paper W while adjusting the position of the image formed on the second side of the paper W based on the calculated ratio of expansion and contraction in the sub-scanning direction and the calculated ratio of expansion and contraction in the main scanning direction.

Therefore, if the paper W is expanded or contracted by heat applied during image forming for the first side of the paper W in the main scanning direction as well as the sub-scanning direction, the position of the image for the second side of the paper W can be adjusted to such expansion and contraction so that the positions of the images on the first side and the second side of the paper W can be suitably aligned.

In the printing system related to this embodiment, it is preferable for the mark sensor 31 provided to the second printing apparatus 2 to have two detection units (hereinafter, one of the two is referred to as a first mark sensor 31*a* and, the other, a second mark sensor 31*b*) to detect the mark 41 at two different mark detection positions which have the same position relative to the sub-scanning direction but different relative to the main scanning direction. The first mark sensor 31*a* outputs the first passing-through time representing the time taken for the portion of the predetermined gap between the first mark portion and the second mark portion of the mark 41 passing through one of the mark detection positions and the second passing-through time representing the time taken for the first mark portion of the mark 41 passing through the one of the mark detection positions to the control unit 20.

In addition, the second mark sensor 31*b* outputs the first passing-through time representing the time taken for the portion of the predetermined gap between the first mark portion and the second mark portion of the mark 41 passing through the other mark detection position and the second passing-through time representing the time taken for the first mark portion of the mark 41 passing through the other mark detection position to the control unit 20.

When the first passing-through times and the second passing-through times are output from the first mark sensor 31*a* and the second mark sensor 31*b*, the control unit 20 can calculate not only the ratio of expansion and contraction in the sub-scanning direction and the ratio of expansion and contraction in the main scanning direction of the paper W but also the amount of meandering of the paper W in the main scanning direction (hereinafter referred to as the meandering amount) based on the first passing-through time and the second passing-through time input from the first mark sensor 31*a* and the first passing-through time and the second passing-through time input from the second mark sensor 31*b*. In addition, the control unit 20 can calculate the ratio of expansion and contraction in the main scanning direction precisely without an error caused by the meandering amount. A specific calculation method is deferred.

As the method of placing the paper W in the printing system related to the embodiment, a specific example thereof is that an operator places the paper W in a paper feeder of the first printing apparatus 1, presses the feed button provided to the operation panel to feed the paper W in an amount enough for the paper W to reach the second printing apparatus 2 via the reversing device 3, and placing the fed paper W in the second printing apparatus 2 manually.

This is only one example of the method of placing the paper W and any known method can be also suitably applicable.

In addition, in the printing system related to this embodiment, when an image is formed only on one side of the paper W, it is possible to form an image only by the first printing apparatus 1 without using the second printing apparatus 2.

However, the paper W of which the image is formed on one side is transferred to the second printing apparatus 2 and accumulated in the discharging tray of the second printing apparatus 2. The printing system may operate the first printing apparatus 1 and the second printing apparatus 2 without using the reversing device 3 to print images on the same side of the paper W (i.e., the first printing apparatus 1 and the second printing apparatus 2 form images on different pages).

Figure 2:
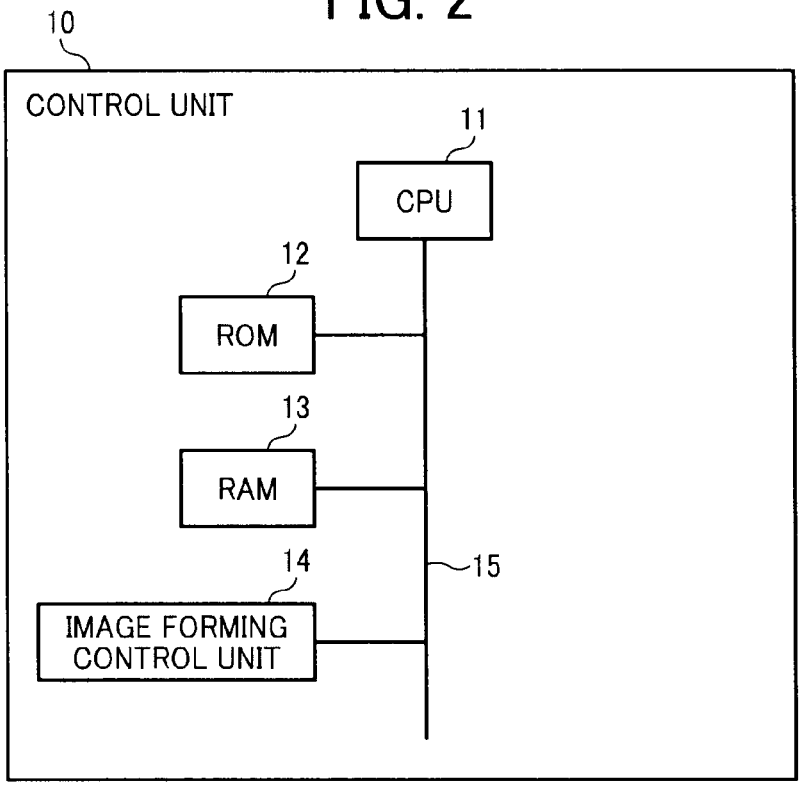
FIG. 2 is a block diagram illustrating an example of the structure of a control unit of a first image forming apparatus (printing apparatus)
Figure 3:
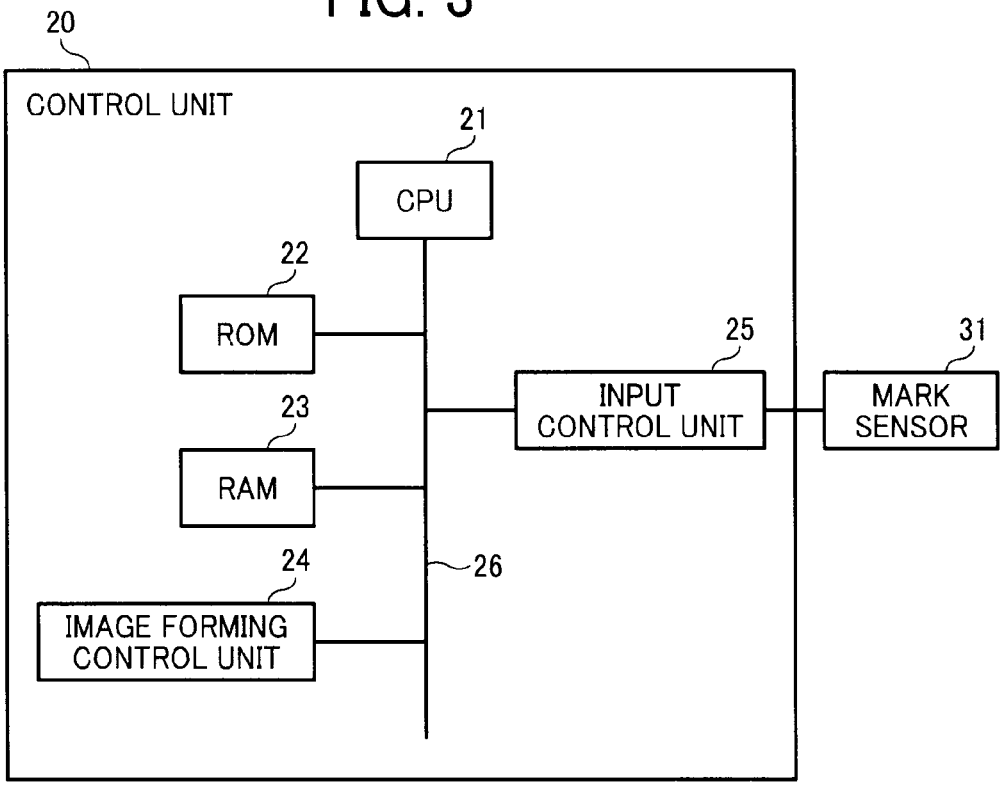
FIG. 3 is a block diagram illustrating an example of the structure of a control unit of a second image forming apparatus (printing apparatus)

Next, the control unit 10 of the first printing apparatus 1 and the control unit 20 of the second printing apparatus 2 are described. FIG. 2 is a block diagram illustrating the main part of the control unit 10 of the first printing apparatus 1 and FIG. 3 is a block diagram illustrating the main part of the control unit 20 of the second printing apparatus 2.

As illustrated in FIG. 2, the control unit 10 of the first printing apparatus 1 includes a CPU 11, a ROM 12, a RAM 13, and an image forming control unit 14. The CPU 11, the ROM 12, the RAM 13, and the image forming control unit 14 are connected by a system bus 15.

The CPU 11 is a central processing unit that controls the first printing apparatus 1 and performs various kinds of processing including forming the mark 41 on the first side of the paper W.

The ROM 12 is a read-only memory that stores programs executed by the CPU 11.

The RAM 13 is a random access memory used as a working area where the CPU 11 spreads out programs and executes various kinds of processing.

The mage forming control unit 14 controls the image forming unit provided inside the first printing apparatus 1 based on instructions from the CPU 11. The image forming control unit 14 forms a toner image including the mark 41 on the image bearing member 16 illustrated in FIG. 1, heats the heating roller 17, and controls driving of the image bearing member 16, the heating roller 17, the pressing roller 18, the feeding roller 19, and each device such as the charger, the irradiation device, the development device, the discharging device, and the cleaning device.

In the first printing apparatus 1, for example, the CPU 11 of the control unit 10 executes the program stored in the ROM 12 and controls the image forming unit by providing instructions to the image forming control unit 14 to form the mark 41 together with an image on the first side of the paper W. That is, in the first printing apparatus 1, the CPU 11 of the control unit 10, the image forming control unit 14, and the image forming unit serve as the mark forming devices.

The control unit 20 of the second printing apparatus 2 has a CPU 21, a ROM 22, a RAM 23, an image forming control unit 24, and an input control unit 25. The CPU 21, the ROM 22, the RAM 23, the image forming control unit 24, and the input control unit 25 are connected by a system bus 26.

The CPU 21 is a central processing unit that controls the first printing apparatus 2 and executes various kinds of processing including processing of calculating the ratio of expansion and contraction in the sub-scanning direction and the ratio of expansion and contraction in the main scanning direction of the paper W (furthermore, the meandering amount if the mark sensor 31 has the first mark sensor 31*a* and the second mark sensor 31*b*) based on the first passing-through time and the second passing-through time input from the mark sensor 31 and processing of adjusting the position of the image formed on the second side of the paper W according to the calculated ratio of expansion and contraction in the sub-scanning direction and the calculated ratio of expansion and contraction in the main scanning direction.

The ROM 22 is a read only memory that stores the programs executed by the CPU 21.

The RAM 23 is a random access memory used as a working area where the CPU 21 spreads out programs and executes various kinds of processing.

The image forming control unit 24 controls the image forming unit inside the second printing apparatus 2 based on instructions from the CPU 21, forms a toner image on the image bearing member 27 illustrated in FIG. 1, heats the heating roller 28, and controls driving of each device such as image bearing member 27, the heating roller 28, the feeding roller 30, the charger, the irradiation device, the development device, the discharging device, and the cleaning device.

The input control unit 25 receives the information of the first passing-through time and the second passing-through time output from the mark sensor 31 and sends it to the CPU 21.

In the second printing apparatus 2, for example, the CPU 21 of the control unit 20 executes the program stored in the ROM 22 to execute processing of calculating the ratio of expansion and contraction in the sub-scanning direction and the ratio of expansion and contraction in the main scanning direction of the paper w (furthermore, the meandering amount if the mark sensor 31 has the first mark sensor 31*a* and the second mark sensor 31*b*) based on the first passing-through time and the second passing-through time input from the mark sensor 31.

In the second printing apparatus 2, for example, the CPU 21 of the control unit 20 executes the program stored in the ROM 22 and controls the image forming unit by providing instructions to the image forming control unit 24 to adjust the position of the image formed on the second side of the paper W. That is, in the second printing apparatus 2, the CPU 21 of the control unit 20 serves as a calculator. In addition, in the second printing apparatus 2, the CPU 21, the image forming control unit 24, and the image forming unit serve as an image adjusting device.

Figure 4:
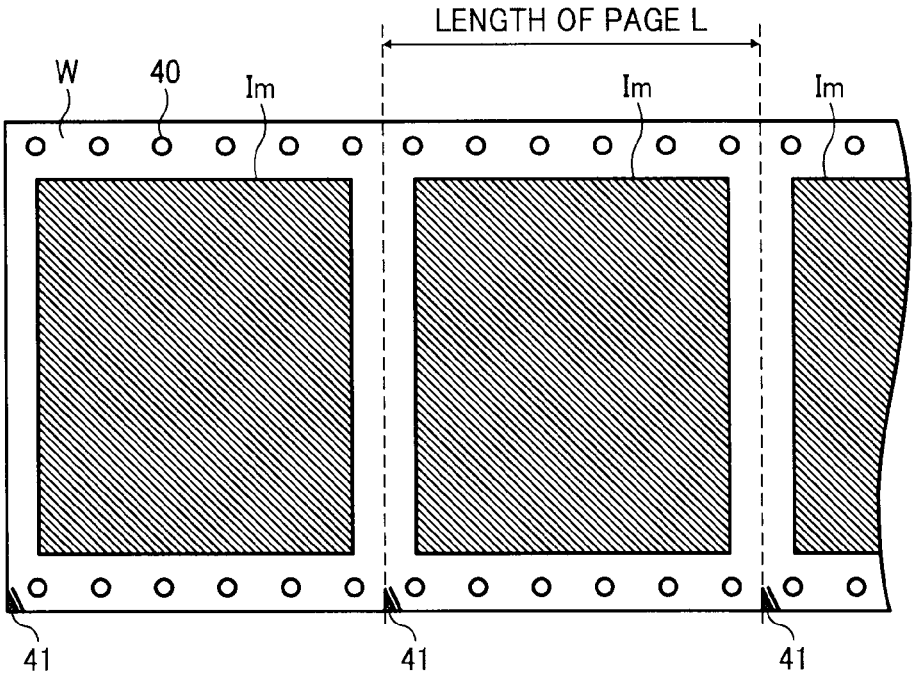
FIG. 4 is a diagram illustrating an example of a recording medium (paper) on which a mark is formed by the first image forming apparatus.
Figure 4:
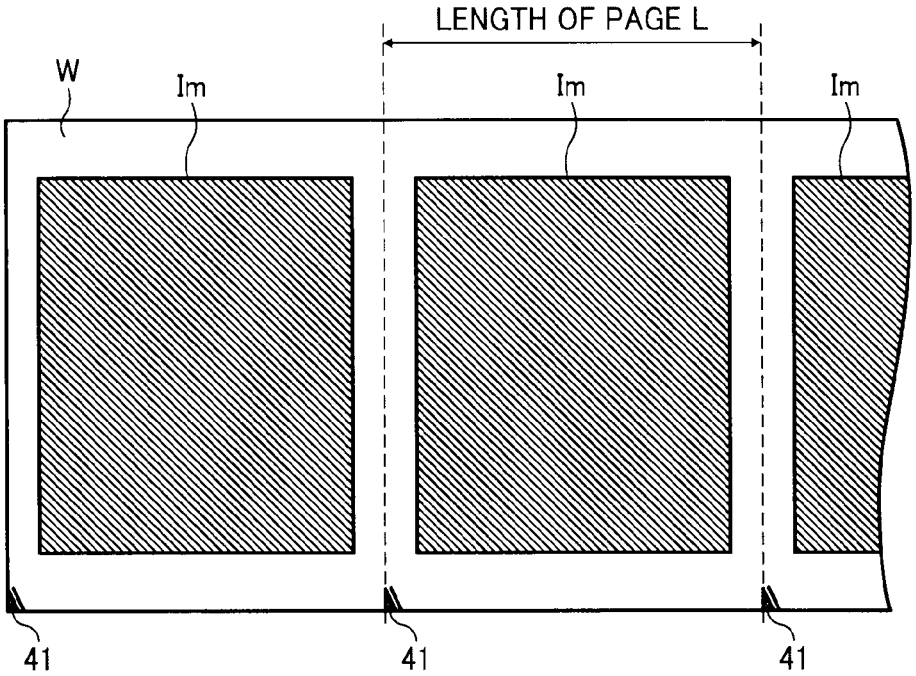

Next, the position of forming the mark 41 on the paper W is described. FIG. 4 is a diagram illustrating the paper W on which the mark 41 is formed by the first printing apparatus 1 illustrated in FIG. 1.

The paper W for use in the printing system related to the present disclosure is divided into the two types; one is a type having a feed hole 40 on the peripheral part in parallel to the sub-scanning direction as illustrated in FIG. 4A and the other, a type having no feed holes as illustrated in FIG. 4B. In this embodiment, the paper W illustrated in FIG. 4B is used. When the paper W having the feed hole 40 illustrated in FIG. 4A is used, the first printing apparatus 1 and the second printing apparatus 2 are required to have a transfer device to transfer the paper W by engagement by inserting pins into the feeding hole 40 provided to the paper W. However, the transfer device is a known technology and the description thereof is omitted.

In addition to an image Im based on the image data (printing data), the mark 41 is formed on the positions with an equal gap therebetween (e.g., position per the page length L) including the front position of each page by the first printing apparatus 1. The equal gap may be determined to be shorter than the page length L. In the present disclosure, as described above, the CPU 11 of the control unit 10 of the first printing apparatus 1 executes the program stored in the ROM 12 and provides instructions to the image forming control unit 14 to control the image forming unit, thereby demonstrating the functions to form the mark 41 together with the image Im on the first side of the paper W. However, a device to form the mark 41 can be provided independently from the device to form the image Im.

The paper W on which the mark 41 is formed on the first side by the first printing apparatus 1 is discharged from the first printing apparatus 1, reversed by the reversing device 3, and sent into the second printing apparatus 2. Therefore, in the second printing apparatus 2, the first side of the paper W on which the mark 41 is formed faces the detection side of the mark sensor 31 so that the mark 41 formed on the first side of the paper W can be detected by the mark sensor 31.

Next, specific examples of the mark 41 are described. As described above, the mark 41 has the first mark portion having a different form depending on the position relative to the main scanning direction and the second mark portion arranged in parallel to one of the sides except the side parallel to the sub-scanning direction of the first mark portion with a predetermined gap therebetween.

Figure 5:
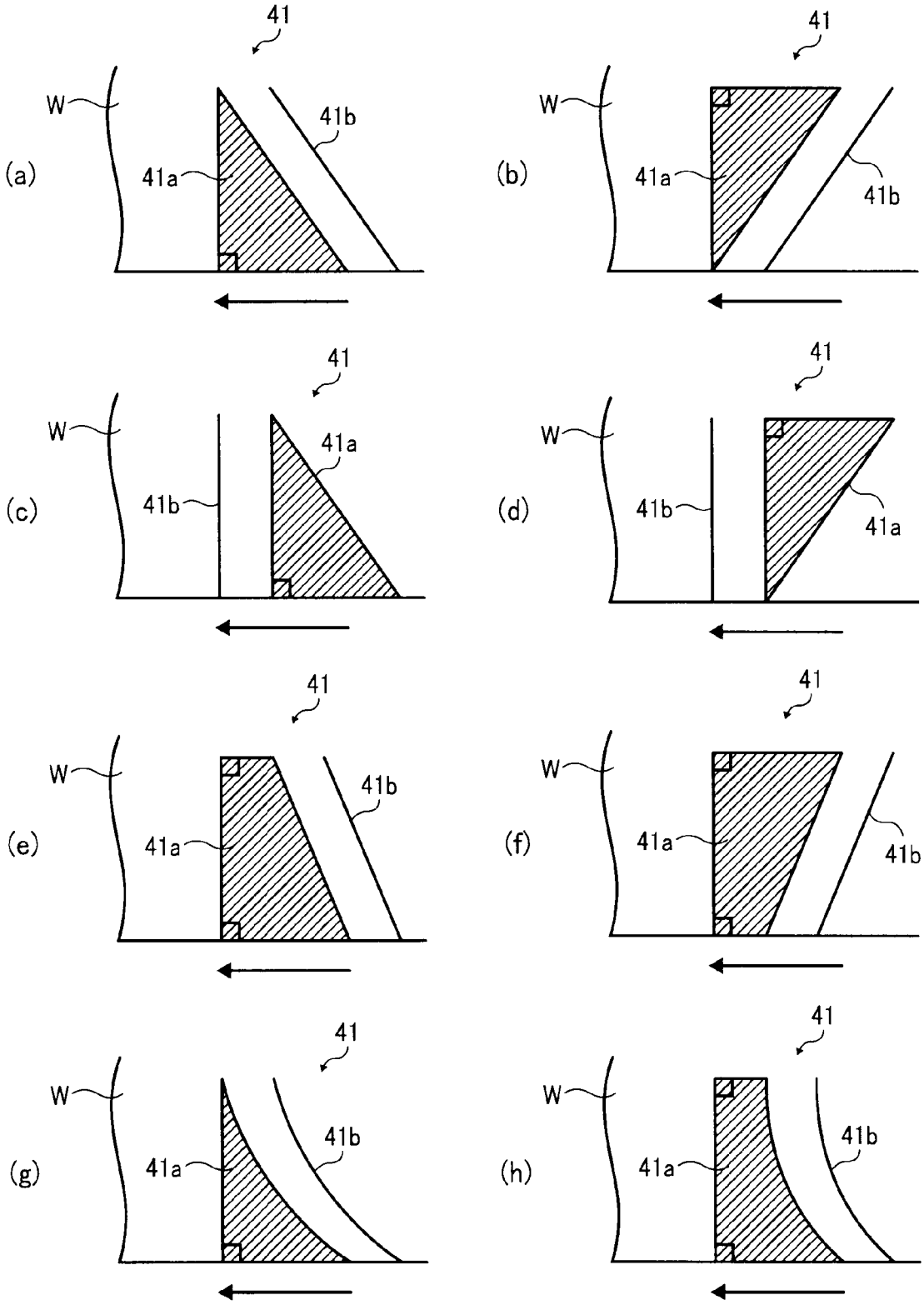
FIG. 5 is a diagram illustrating an example of the mark.

FIG. 5 is a specific example of the mark 41 satisfying the condition specified above. An arrow in FIG. 5 indicates the conveyance direction (the sub-scanning direction) of the paper W.

FIGS. 5*a* and 5*b* are diagrams illustrating examples of the mark 41 having the first mark portion 41*a* having a right triangle form and the second mark portion 41*b* which is a line arranged on the downstream side of the first mark portion 41*a* relative to the conveyance direction of the paper W such that the second mark 41*b* is in parallel to the hypotenuse of the right triangle of the first mark portion 41*a* with a predetermined gap therebetween. The mark 41 illustrated in FIG. 5*b* is an example of reversing the mark 41 illustrated in FIG. 5*a* relative to the main scanning direction.

FIGS. 5*c* and 5*d* are diagrams illustrating examples of the mark 41 having the first mark portion 41*a* having a right triangle form and the second mark portion 41*b* which is a line arranged on the upstream side of the first mark portion 41*a* relative to the conveyance direction of the paper W such that the second mark 41*b* is in parallel to the long side of the right triangle of the first mark portion 41*a* with a predetermined gap therebetween. The mark 41 illustrated in FIG. 5*d* is an example of reversing the mark 41 illustrated in FIG. 5*c* relative to the main scanning direction.

The mark 41 illustrated in FIGS. 5*a* to 5*d* are arranged such that the short side of the right triangle of the first mark portion 41*a* is arranged along the sub-scanning direction and, the long-side, the main scanning direction. This arrangement can be reversed such that the long side of the right triangle of the first mark portion 41*a* is arranged along the sub-scanning direction and, the short-side, the main scanning direction. In addition, when the two sides other than the hypotenuse of the right triangle of the first mark portion 41*a* have the same length, one of the two sides are arranged along the sub-scanning direction and, the other, the main scanning direction.

The mark 41 illustrated in FIGS. 5*e* and 5*f* has a first mark portion 41*a* having a trapezoid form having two inner angles of 90 degrees and a second mark portion 41*b* which is a line arranged on the downstream side of the first mark portion 41*a* relative to the conveyance direction of the paper W such that the second mark 41*b* is in parallel to the hypotenuse of the trapezoid of the first mark portion 41*a* with a predetermined gap therebetween. The mark 41 illustrated in FIG. 5*f* is an example of reversing the mark 41 illustrated in FIG. 5*e* relative to the main scanning direction. In the mark 41 illustrated in FIGS. 5*e* and 5*f*, although the second mark portion 41*b* is arranged on the downstream side of the first mark portion 41*a* relative to the conveyance direction of the paper W but can be arranged vice versa.

FIG. 5*g* is a diagram illustrating an example of the mark 41 formed by replacing the hypotenuse of the right triangle of the first mark portion 41*a* illustrated in FIG. 5*a* with a quadric curve. FIG. 5*h* is an example of the mark 41 formed by replacing the hypotenuse of the trapezoid of the first mark portion 41*a* illustrated in FIG. 5*e* with a quadric curve. Although the examples are illustrated in which the mark 41 formed by replacing the hypotenuse of the right triangle of the first mark portion 41*a* illustrated in FIG. 5*a* with a quadric curve and the mark 41 formed by replacing the hypotenuse of the trapezoid of the first mark portion 41*a* illustrated in FIG. 5*e* with a quadric curve, the mark 41 formed by replacing the hypotenuse of a form other than those illustrated in FIGS. 5*a* and 5*e* of the first mark portion 41*a* of with a quadric curve can be also used.

In addition, the mark 41 is not limited to the forms illustrated in FIGS. 5*a* to 5*e* but any mark 41 can be used which has the first mark portion 41*a* having a length in the sub-scanning direction changing depending on the position relative to the main scanning direction and the second mark portion 41*b* arranged in parallel to one of the sides except the side arranged parallel to the sub-scanning direction of the first mark portion with a predetermined gap therebetween.

Irrespective of the structure of the mark 41, the ratio of expansion and contraction in the sub-scanning direction of the paper W can be obtained by the ratio of the first passing-through time representing the time taken for the portion of the predetermined gap between the first mark portion and the second mark portion of the mark 41 passing through the mark detection position to a first reference time. The first reference time means the first passing-through time obtained in the state in which no length changes in the sub-scanning direction of the paper W (i.e., no expansion and contraction in the sub-scanning direction occurs). The first reference time is preliminarily measured and saved in the ROM 22 inside the control unit 20 of the second image forming apparatus 2, a separately provided non-volatile memory, etc.

Furthermore, irrespective of the structure of the mark 41 described above, the ratio of expansion and contraction in the main scanning direction of the paper W can be obtained by, for example, the ratio of the second passing-through time representing the time taken for the first mark portion of the mark 41 passing through the mark detection position to a second reference time, the ratio of expansion and contraction in the sub-scanning direction, and a function representing the relationship of the length in the sub-scanning direction according to the position of the first mark portion 41*a* in the main scanning direction. The second reference time means the second passing-through time in the state in which no length changes in the sub-scanning direction and the main scanning direction of the paper W (no expansion and contraction in the sub-scanning direction and the main scanning direction). The second reference time is preliminarily measured and saved in the ROM 22 provided inside the control unit 20 of the second image forming apparatus 2, a separately provided non-volatile memory, etc. The function representing the relationship of the length in the sub-scanning direction depending on the position relative to the main scanning direction of the first mark portion 41*a* is unambiguously lead by the form of the first mark portion 41*a*, preliminarily made, and saved in the ROM 22 inside the control unit 20 of the second image forming apparatus 2, a separately provided non-volatile memory, etc.

The method of calculating the ratio of expansion and contraction in the main scanning direction mentioned above is based on that the paper W is transferred without meandering. If the paper W meanders while it is being transferred, the calculation result has an error depending on the meandering amount. To calculate the ratio of expansion and contraction in the main scanning direction precisely by removing the impact of the meandering in the main scanning direction of the paper W, it is preferable that the mark sensor 31 is constituted of the first mark sensor 31*a* and the second mark sensor 31*b* that detect the mark 41 at different positions relative to the main scanning direction to obtain the second passing-through time at the two mark detection positions as described above. In this case, by using the relative positions of the two mark detection positions and the second passing-through times at the two mark detection positions, the ratio of expansion and contraction in the main scanning direction can be precisely obtained without being affected by the meandering even if the paper W meanders in the main scanning direction and in addition the meandering amount can be also obtained.

In addition, in particular, if the mark 41 is structured such that the first mark portion 41*a* has a right triangle and the first mark sensor 31*a* and the second mark sensor 31*b* separately detect the mark 41 at the two positions so as to trisect the side (second side) arranged along the main scanning direction among the two sides except for the hypotenuse of the right triangle , the ratio of expansion and contraction in the main scanning direction and the meandering amount can be calculated by a simple geometric calculation while eliminating the impact of the meandering. For the mark 41 having the structure illustrated in FIG. 5*a*, the methods of calculating the ratio of expansion and contraction in the sub-scanning direction, the ratio of expansion and contraction in the main scanning direction, and the meandering amount are described in detail by specifying an example in which the first mark sensor 31*a* and the second mark sensor 31*b* separately detect the mark 41 at the two positions so as to trisect the side (second side) arranged along the main scanning direction of the first mark portion 41*a* of the right triangle.

Figure 6:
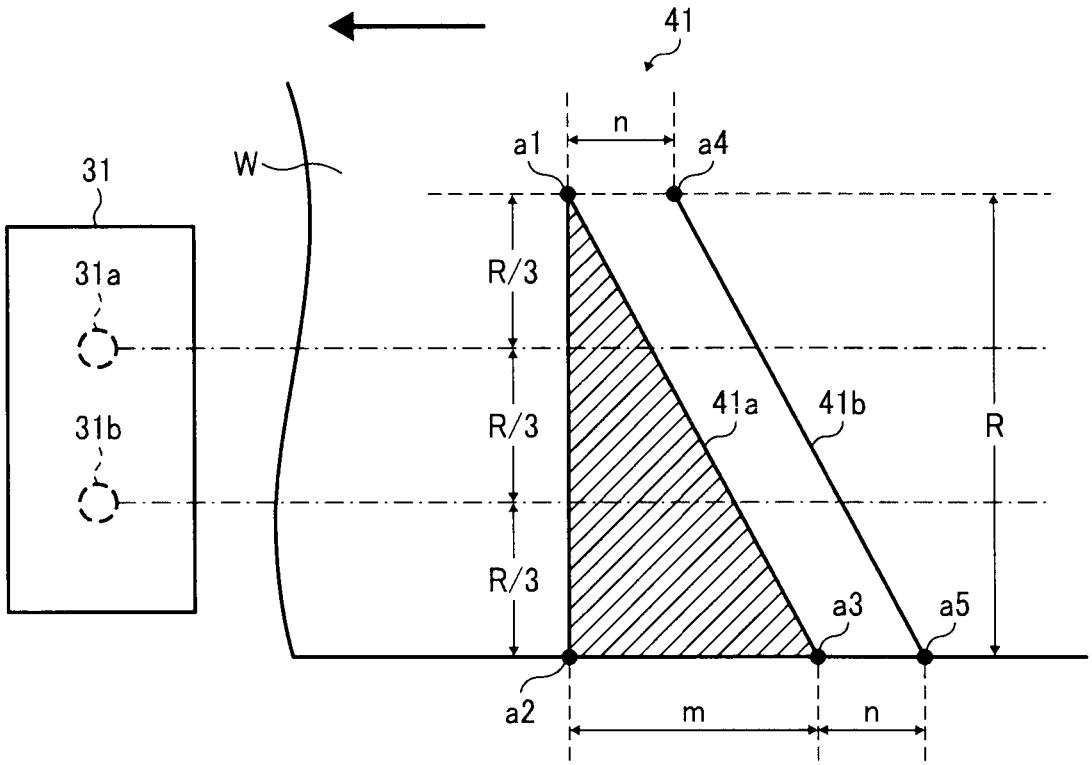
FIG. 6 is a diagram illustrating the relative positions of the mark having a structure illustrated in FIG. 5A and a mark sensor.

FIG. 6 is a diagram illustrating the positional relationship between the mark 41 and the mark sensor 31 illustrated in FIG. 5*a*. An arrow in FIG. 5 indicates the conveyance direction (the sub-scanning direction) of the paper W. As illustrated in FIG. 6, the mark 41 includes the first mark portion 41*a* having a right triangle form and the second mark portion 41*b* which is a straight line a4-a5 arranged in parallel to the hypotenuse a1-a3 of the first mark portion 41*a* with a predetermined gap of n (n represents a positive number) between the first mark portion 41*a* and the second mark portion 41*b*.

The mark 41 is formed on the peripheral in parallel to the conveyance direction of the first side of the paper W. In addition, a plurality of the marks 41 are formed on the positions including, for example, the front position of the page of the paper W with an equal gap therebetween.

The first mark portion 41*a* having a right triangle form is formed on the first side of the paper W such that the short side a2-a3 is arranged along the sub-scanning direction and the long side a1-a2 is arranged along the main scanning direction. In addition, the second mark portion 41*b* is formed on the first side of the paper W such that the second mark portion 41*b* is arranged on the downstream side of the first mark portion 41*a* relative to the conveyance direction of the paper W. Hereinafter, the length (distance) of the long side a1-a2 of the first mark portion 41*a* is represented by R and the length (distance) of the short side a2-a3 of the first mark portion 41*a* is represented by m.

The mark sensor 31 has a structure of the two detection portions of the first mark sensor 31*a* and the second mark sensor 31*b* arranged along the main scanning direction.

The first mark sensor 31*a* and the second mark sensor 31*b* are placed at the two positions so as to trisect the long side a1-a2 of the first mark portion 41*a* to detect the mark formed on the first side of the paper W. That is, the first mark sensor 31*a* is arranged at the position which is shifted from a vertex a1 of the first mark portion 41*a* having a right triangle to the side of a vertex a2 thereof with a distance of R/3(i.e., a third of R) to detect the mark 41. In addition, the second mark sensor 31*b* is arranged at the position which is shifted from the vertex a2 of the first mark portion 41*a* having a right triangle to the side of the vertex a1 thereof with a distance of R/3(i.e., a third of R) to detect the mark 41. Although the first mark sensor 31*a* and the second mark sensor 31*b* are housed in a single chassis in FIG. 6, these can be arranged in separate chassis.

Next, for the structure illustrated in FIG. 6, how the control unit 20 of the second printing apparatus 2 calculates the ratio of expansion and contraction in the sub-scanning direction, the ratio of expansion and contraction in the main scanning direction, and the meandering amount of the paper W is specified in detail.

Figure 7:
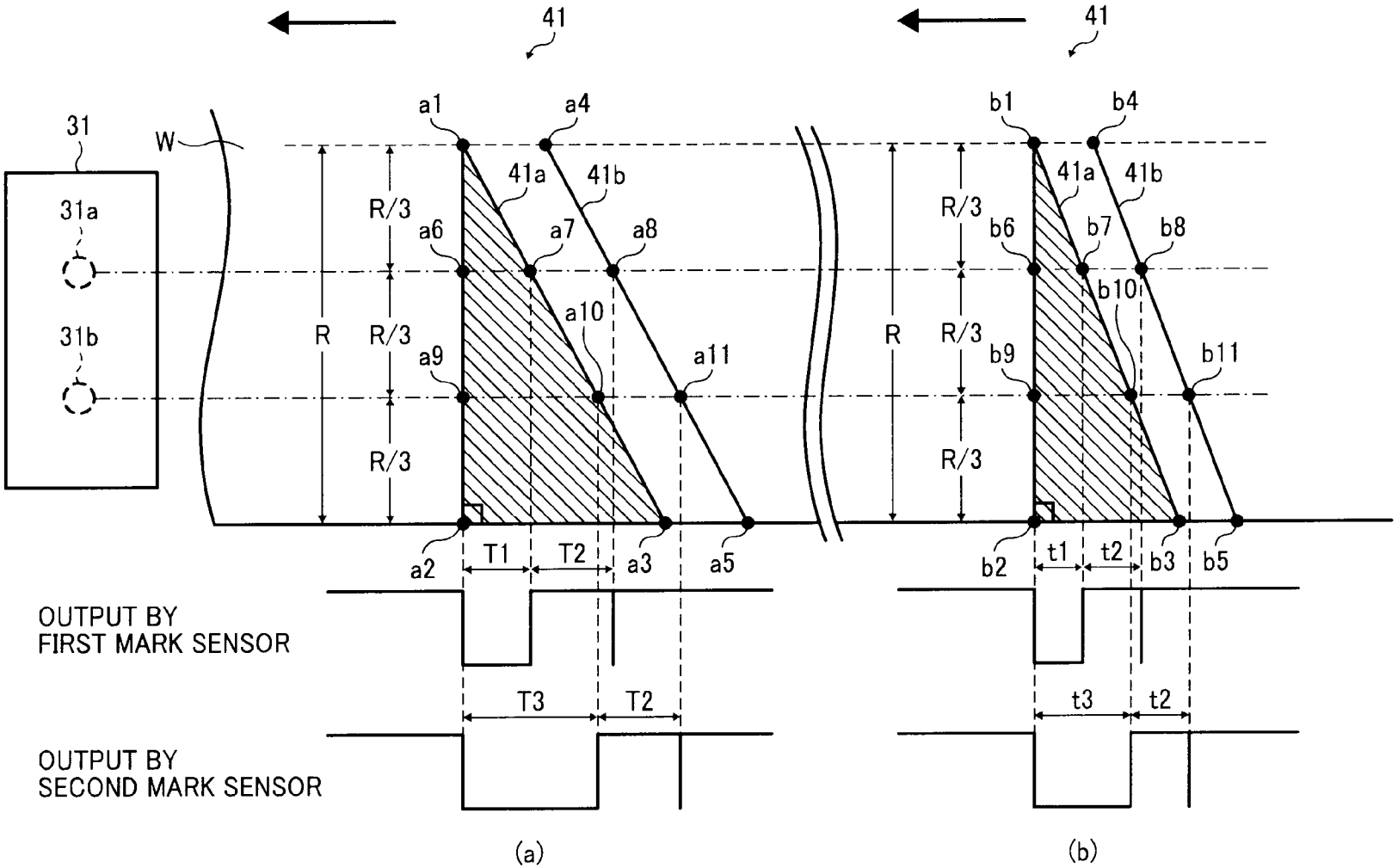
FIG. 7 is a diagram illustrating a process of calculating a ratio of expansion and contraction in the sub-scanning direction by the control unit of the second image forming apparatus.

First, the calculation processing of the ratio of expansion and contraction in the sub-scanning direction is described. FIG. 7 is a diagram illustrating the processing of the control unit 20 of the second printing apparatus 2 calculating the ratio of expansion and contraction in the sub-scanning direction of the paper W. The line indicated by a dashed line in FIG. 7 shows the position of the first mark sensor 31*a* relative to the main scanning direction and the position of the second mark sensor 31*b* relative to the main scanning direction. In addition, an arrow in FIG. 7 indicates the conveyance direction of the paper W transferred at a conveyance speed of v (m/s).

FIG. 7*a* is a diagram illustrating a case in which the first mark sensor 31*a* and the second mark sensor 31*b* detect the mark 41 in the state in which no expansion or contraction by heat occurs to the paper W. In FIG. 7*a*, the three vertexes of the first mark portion 41*a* are illustrated as the points of a1 to a3 and the point a2 has a right angle. In addition, both ends of the second mark portion 41*b* are represented by points a4 and a5.

In the example illustrated in FIG. 7*a*, the first mark sensor 31*a* outputs a low level signal representing the second passing-through time T1 while the portion between a point a6 and a point a7 of the first mark portion 41*a* of the mark 41 passes through the position (mark detection position) of the first mark sensor 31*a*. In addition, the first mark sensor 31*a* outputs a high level signal representing the first passing-through time T2 while the portion of the predetermined gap (represented by n in FIG. 6) in the mark 41 between the point a7 of the first mark portion 41*a* and a point a8 of the second mark portion 41*b* passes through the mark detection position.

The second mark sensor 31*b* outputs a low level signal representing the second passing-through time T3 while the portion between a point a9 and a point a10 of the first mark portion 41*a* of the mark 41 passes through the position (mark detection position) of the second mark sensor 31*b*. In addition, the second mark sensor 31*b* outputs a high level signal representing the first passing-through time T2 while the portion of the predetermined gap in the mark 41 between the point a10 of the first mark portion 41*a* and a point all of the second mark portion 41*b* passes through the mark detection position.

The second mark portion 41*b* is arranged in parallel to the hypotenuse of the first mark portion 41*a* having aright triangle. Therefore, the first passing-through time T2 output from the first mark sensor 31*a* is equal to the first passing-through time T2 output from the second mark sensor 31*b*.

The CPU 21 of the control unit 20 stores the first passing-through time T2 output from the first mark sensor 31*a* and the second mark sensor 31*b* as a first reference time tb in a memory such as the ROM 22 when the paper W having no expansion or contraction by heat is transferred as described in the example illustrated in FIG. 7*a*.

FIG. 7*b* is an example in which the first mark sensor 31*a* and the second mark sensor 31*b* detect the mark 41 in the state in which the paper W is contracted in the sub-scanning direction by heat during image forming on the first side. In FIG. 7*b*, the three vertexes of the first mark portion 41*a* are illustrated as the points of b1 to b3 and the point b2 has a right angle. In addition, both ends of the second mark portion 41*b* are represented by points b4 and b5. The mark 41 illustrated in FIG. 7*b* has a short side b2-b3 of the first mark portion 41*a* having a right triangle form shorter than the short side a2-a3 of FIG. 7*a* free from expansion or contraction. The distance between the hypotenuse b1 to b3 of the first mark portion 41*a* having a right triangle form and the second mark portion 41*b* is relatively narrow in comparison with the example illustrated in FIG. 7*a* free from expansion or contraction.

In the case illustrated in FIG. 7*b*, the first mark sensor 31*a* outputs a low level signal representing the second passing-through time t1 while the portion between a point b6 and a point b7 of the first mark portion 41*a* of the mark 41 passes through the position (mark detection position) of the first mark sensor 31*a*. In addition, the first mark sensor 31*a* outputs a high level signal representing the first passing-through time t2 while the portion of the predetermined gap in the mark 41 between a point b7 of the first mark portion 41*a* and a point b8 of the second mark portion 41*b* passes through the mark detection position.

The second mark sensor 31*b* outputs a low level signal representing the second passing-through time t3 while the portion between a point b9 and a point b10 of the first mark portion 41*a* of the mark 41 passes through the position (mark detection position) of the second mark sensor 31*b*. In addition, the second mark sensor 31*b* outputs a high level signal representing the first passing-through time t2 while the portion of the predetermined gap in the mark 41 between the point b10 of the first mark portion 41*a* and a point b11 of the second mark portion 41*b* passes through the mark detection position.

The second mark portion 41*b* is arranged in parallel to the hypotenuse of the first mark portion 41*b* having a right triangle form. Therefore, the first passing-through time t2 output from the first mark sensor 31*a* is equal to the first passing-through time t2 output from the second mark sensor 31*b* even if the paper is expanded or contracted in the sub-scanning direction.

The CPU 21 of the control unit 20 uses the first passing-through time t2 output from the first mark sensor 31*a* and the second mark sensor 31*b* as a first reference time ta to obtain the ratio of expansion and contraction in the sub-scanning direction.

The ratio of expansion and contraction in the sub-scanning direction of the paper W can be calculated by the ratio of the first passing-through time when expansion or contraction occurs to the paper W in the sub-scanning direction to the first passing-through time when no expansion or contraction occurs to the paper W. That is, the ratio a of expansion and contraction in the sub-scanning direction is calculated by the following relationship 1 from the first reference time tb and the first passing-through time ta.

$$\alpha a = ta/tb \qquad \text{Relationship 1}$$

The CPU 21 of the control unit 20 calculates the ratio α of expansion and contraction in the sub-scanning direction of the paper W by an operation processing based on the relationship 1.

Figure 8:
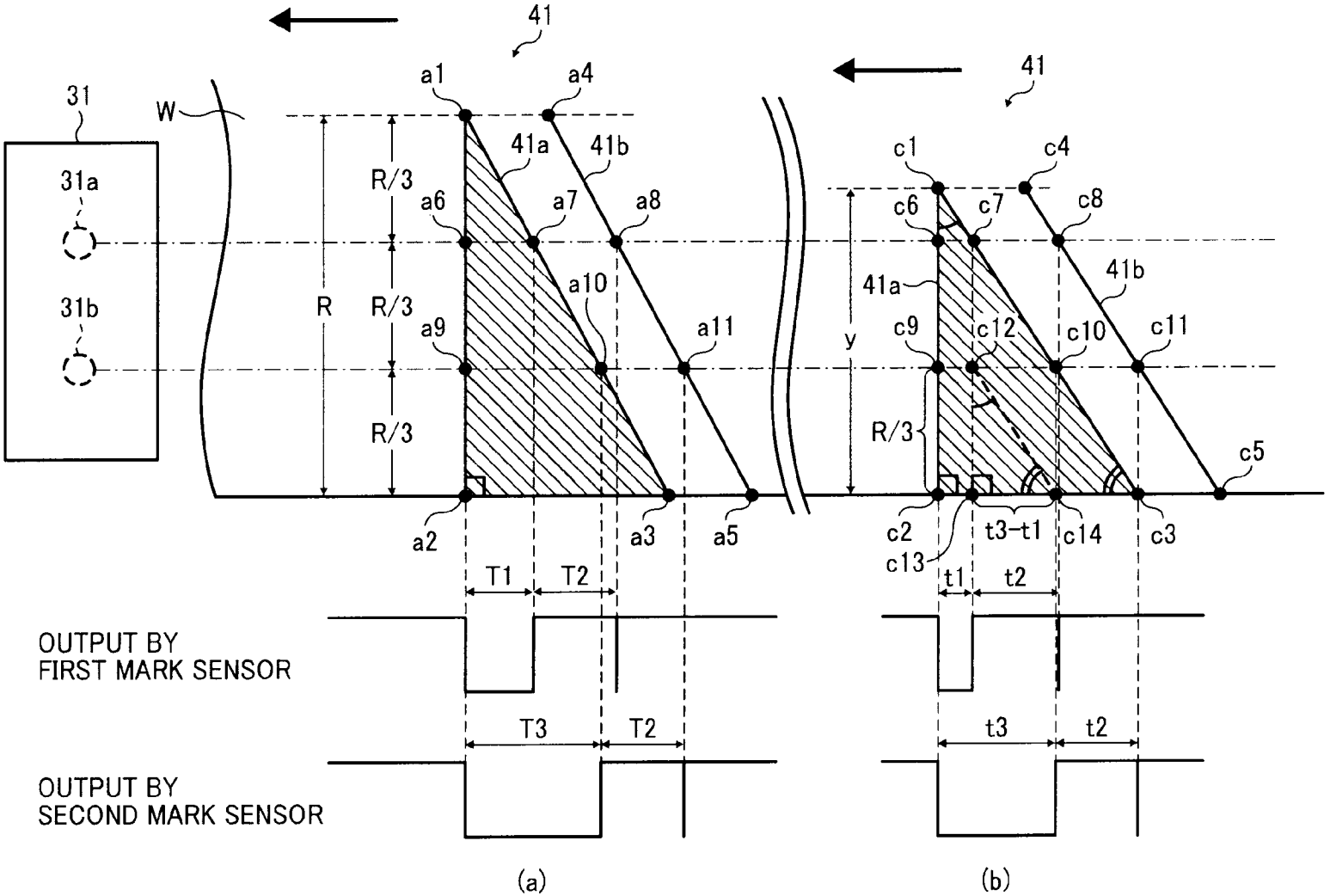
FIG. 8 is a diagram illustrating a process of calculating the ratio of the expansion and contraction of the recording medium in the main scanning direction by the control unit of the second image forming apparatus.

Next, the calculation processing of the ratio of expansion and contraction in the main canning direction is described. FIG. 8 is a diagram illustrating the processing of the control unit 20 of the second printing apparatus 2 calculating the ratio of expansion and contraction in the main scanning direction of the paper W.

The line indicated by a dashed line in FIG. 8 shows the position of the first mark sensor 31*a* relative to the main scanning direction and the position of the second mark sensor 31*b* relative to the main scanning direction. In addition, an arrow in FIG. 7 indicates the conveyance direction of the paper W transferred at a conveyance speed of v (m/s).

FIG. 8*a* is a diagram illustrating an example in which the first mark sensor 31*a* and the second mark sensor 31*b* detect the mark 41 in the state in which no expansion or contraction by heat occurs to the paper W. A description of the example illustrated in FIG. 8*a* is omitted because it is the same as that illustrated in FIG. 7*a*.

FIG. 8*b* is an example in which the first mark sensor 31*a* and the second mark sensor 31*b* detect the mark 41 in the state in which the paper w is contracted in the main scanning direction by heat during image forming on the first side. In FIG. 8*b*, the three vertexes of the first mark portion 41*a* are illustrated as the points of c1 to c3 and the point c2 has a right angle. In addition, both ends of the second mark portion 41*b* are represented by points c4 and c5. The mark 41 illustrated in FIG. 8*b* has a long side c1-c2 of the first mark portion 41*a* having a right triangle form shorter than the long side a1-a2 of FIG. 8*a* free from expansion or contraction.

In the example illustrated in FIG. 8*b*, the first mark sensor 31*a* outputs a low level signal representing the second passing-through time t1 while the portion between a point c6 and a point c7 of the first mark portion 41*a* of the mark 41 passes through the position (mark detection position) of the first mark sensor 31*a*.

In addition, the first mark sensor 31*a* outputs a high level signal representing the first passing-through time t2 while the portion of the predetermined gap in the mark 41 between the point c7 of the first mark portion 41*a* and a point c8 of the second mark portion 41*b* passes through the mark detection position.

The second mark sensor 31*b* outputs a low level signal representing the second passing-through time t3 while the portion between a point c9 and a point c10 of the first mark portion 41*a* of the mark 41 passes through the position (mark detection position) of the second mark sensor 31*b*. In addition, the second mark sensor 31*b* outputs a high level signal representing the first passing-through time t2 while the portion of the predetermined gap in the mark 41 between the point c10 of the first mark portion 41*a* and a point c11 of the second mark portion 41*b* passes through the mark detection position.

The CPU 21 of the control unit 20 uses the first passing-through time t2 output from the first mark sensor 31*a* and the second mark sensor 31*b* as the first reference time ta to obtain the ratio of expansion and contraction in the sub-scanning direction. The CPU 21 of the control unit 21 calculates the ratio a of expansion and contraction in the sub-scanning direction of the paper W by an operation processing based on the relationship 1 based on the first reference time tb and the first passing-through time ta.

The CPU 21 of the control unit 20 uses the first passing-through time t1 output from the first mark sensor 31*a* as the second passing-through time tc to obtain the ratio of expansion and contraction in the main scanning direction. The second passing-through time t3 output from the second mark sensor 31*b* is used as the second passing-through time td to obtain the ratio of expansion and contraction in the main scanning direction.

The CPU 21 of the control unit 20 calculates the ratio β of expansion and contraction in the main scanning direction of the paper W by an operation processing based on the following relationship 2 from the above-obtained ratio α of expansion and contraction in the sub-scanning direction of the paper W, the length m of the short side a2-a3 of the first mark portion 41*a*, and the conveyance speed v of the paper W.

$$\beta = (1/3) \times (\alpha \times (m/v)/(td - tc) \qquad \text{Relationship 2}$$

The ratio β of expansion and contraction in the main scanning direction can be calculated from the relationship: α=y/R, based on the length R of the long side a1-a2 of the first mark portion 41*a* having no expansion or contraction and the length y of expanded or contracted long side c1-c2 of the first mark portion 41*a*. With regard to the y of the expanded or contracted long side c1-c2 of the first mark portion 41*a* can be obtained by the scaling relationship of the right triangle.

As illustrated in FIG. 8*b*, the first mark portion 41*a* of a right triangle having the three vertexes of c1 to c3 and a right triangle having three vertexes of c12 to c14 have the two same inner angles and thus have the scaling relationship. Therefore, the ratio of the two sides is the same in the two triangles. That is, the ratio of the length (y) of the side c1-c2 to the length (which is obtained by multiplying the length m of the short side a2-a3 free from expansion or expansion or contraction in the sub-scanning direction with the ratio α of expansion and contraction in the sub-scanning direction is equal to the ratio of the length (=R/3) of the side c12-c13 to the length of the side c13-c14.

When the difference t3−t1 between the second passing-through time t3 output from the second mark sensor 31*b* and the second passing-through time t1 output from the first mark sensor 31*a* corresponds to the length of the side c13-c14, the relationship: $y/R=(1/3)\times\{\alpha\times(m/v)\}\times\{1/(t3-t1)\}$ is obtained from the ratio: $y:R/3=(\alpha\times m/v):(t3-t1)$. Therefore, from the relationship: $\beta=y/R$ and the relationship: $y/R=(1/3)\times\{\alpha\times(m/v)\}\times\{1/(t3-t1)\}$, the relationship: $\beta=(1/3)\times\{\alpha\times(m/v)\}\times\{1/(t3-t1)\}$ is obtained. When the second passing-through time t1 output from the first mark sensor 31*a* is replaced with tc and the second passing-through time t3 output from the second mark sensor 31*b* is replaced with td, the relationship 2 is obtained.

Therefore, the CPU 21 of the control unit 20 can calculate the ratio β of expansion and contraction in the main scanning direction of the paper W by the operation processing based on the relationship 2 using the two second passing-through times tc and td output from the mark sensor 31, the ratio α of expansion and contraction in the sub-scanning direction of the paper W, the length m of the short side a2-a3 of the first mark portion 41*a*, and the conveyance speed v of the paper W. When the paper W is expanded or contracted only in the main scanning direction, α is equal to 1.

Figure 9:
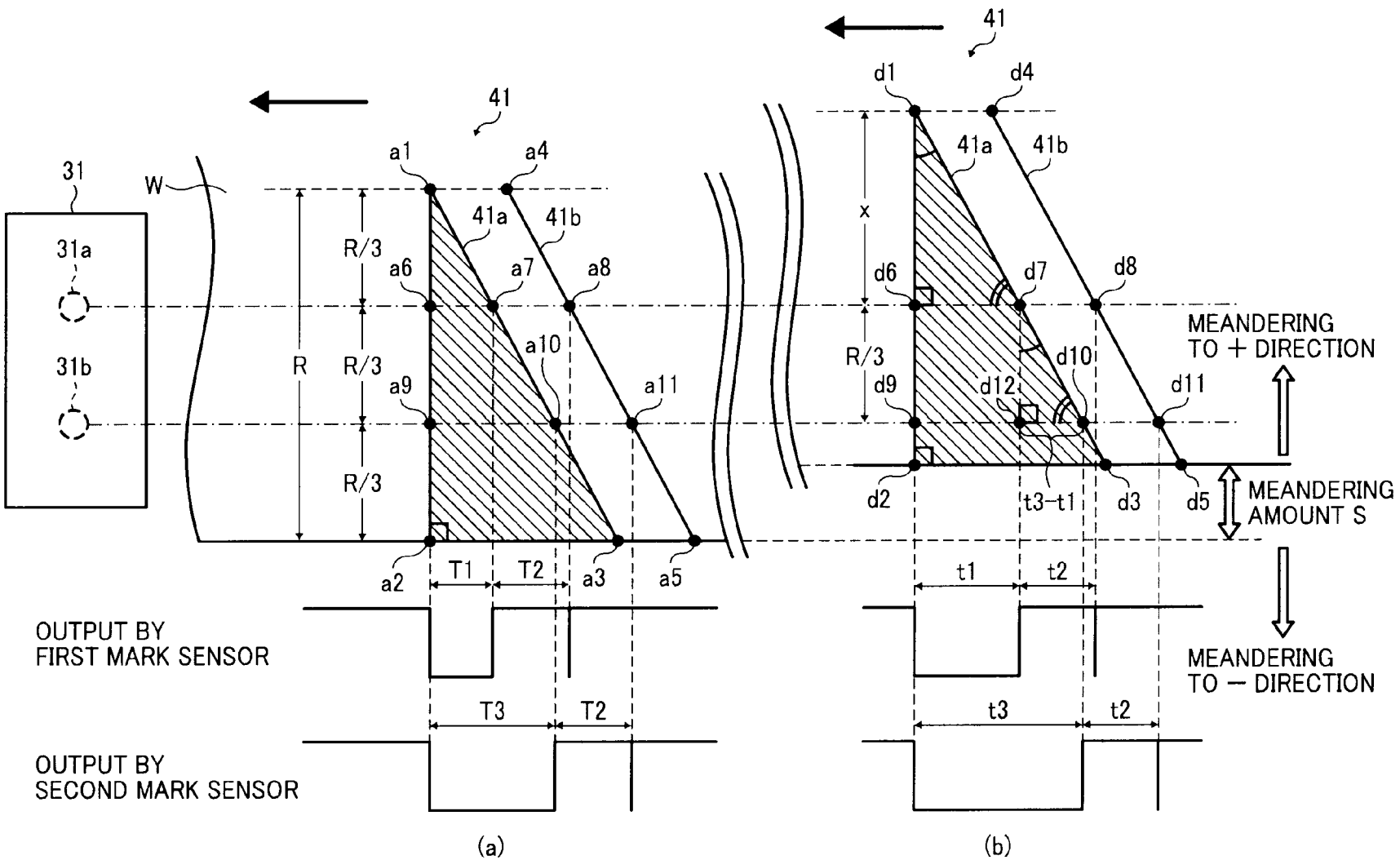
FIG. 9 is a diagram illustrating a process of calculating an amount of meandering of the recording medium by the control unit of the second image forming apparatus.

Next, the processing of calculating the meandering amount is described. FIG. 9 is a diagram illustrating the processing of the control unit 20 of the second printing apparatus 2 calculating the meandering amount of the paper W. A dashed-line in FIG. 9 represents the position of the first mark sensor 31*a* relative to the main scanning direction and the position of the second mark sensor 31*b* relative to the main scanning direction. In addition, an arrow in FIG. 7 indicates the conveyance direction of the paper W transferred at a conveyance speed of v (m/s).

FIG. 9*a* is a diagram illustrating an example in which the first mark sensor 31*a* and the second mark sensor 31*b* detect the mark 41 in the state in which the paper W does not meander during transfer.

A description of the case illustrated in FIG. 9*a* is omitted because it is the same as that illustrated in FIGS. 7*a* and 8*a*.

FIG. 9*b* is a diagram illustrating an example in which the first mark sensor 31*a* and the second mark sensor 31*b* detect the mark 41 when the paper meanders in the main scanning direction during transfer. In FIG. 9*b*, the three vertexes of the first mark portion 41*a* are illustrated as the points of d1 to d3 and the point d2 has a right angle.

In the example illustrated in FIG. 9*b*, the first mark sensor 31*a* outputs a low level signal representing the second passing-through time t1 while the portion between a point d6 and a point d7 of the first mark portion 41*a* of the mark 41 passes through the position (mark detection position) of the first mark sensor 31*a*. In addition, the first mark sensor 31*a* outputs a high level signal representing the first passing-through time t2 while the portion of the predetermined gap in the mark 41 between a point d7 of the first mark portion 41*a* and a point d8 of the second mark portion 41*b* passes through the mark detection position.

The second mark sensor 31*b* outputs a low level signal representing the second passing-through time t3 while the portion between a point d9 and a point d10 of the first mark portion 41*a* of the mark 41 passes through the position (mark detection position) of the second mark sensor 31*b*.

In addition, the second mark sensor 31*b* outputs a high level signal representing the first passing-through time t2 while the portion of the predetermined gap in the mark 41 between the point d10 of the first mark portion 41*a* and a point dli of the second mark portion 41*b* passes through the mark detection position.

The CPU 21 of the control unit 20 uses the first passing-through time t2 output from the first mark sensor 31*a* and the second mark sensor 31*b* as the first reference time to to obtain the ratio of expansion and contraction in the sub-scanning direction. The CPU 21 of the control unit 20 calculates the ratio of expansion and contraction in the sub-scanning direction of the paper W by an operation processing based on the relationship 1 using the first reference time tb and the first passing-through time ta.

In addition, the CPU 21 of the control unit 20 uses the second passing-through time t1 output from the first mark sensor 31*a* as the second passing-through time tc to obtain the ratio of expansion and contraction in the main scanning direction. The second passing-through time t3 output from the second mark sensor 31*b* is used as the second passing-through time td to obtain the ratio of expansion and contraction in the main scanning direction.

The CPU 21 of the control unit 20 calculates the ratio β of expansion and contraction in the main scanning direction of the paper w by an operation processing based on the relationship 2 using the two second passing-through times tc and td, the above-obtained ratio a of expansion and contraction in the sub-scanning direction of the paper W, the length m of the short side a2-a3 of the first mark portion 41*a*, and the conveyance speed v of the paper W.

Furthermore, the CPU 21 of the control unit 20 calculates a meandering amount S of the paper W by an operation processing based on the following relationship 3 using the two second passing-through times tc and td, the above-obtained ratio βof expansion and contraction in the main scanning direction of the paper W, the length R of the long side a1-a2 of the first mark portion 41*a*.

$$S=R/3\times[tc/(td-tc)-1]\times\beta \qquad \text{Relationship 3}$$

As seen in the comparison between FIG. 9*a* and FIG. 9*b*, a length x from the point d1 to the point d6 of the first mark portion 41*a* illustrated in FIG. 9*b* represents the length obtained by adding the expansion and contraction of the main scanning direction and meandering to the length R/3 of from the point al to the point a6 of the first mark portion 41*a* illustrated in FIG. 9*a*. Meaning, $x=(S+R/3)\times\beta$ In addition, as illustrated in FIG. 9*b*, the right triangle having three vertexes of d1, d6, and d7 has the two same inner angles as the right triangle having three vertexes of d7, d12, and d10. Therefore, the two triangles have a scaling relationship and the ratio of the two sides is the same. That is, the ratio of the length (=x) of the side d1-d6 to the length of the side d6-d7 is equal to the ratio of the length (=R/3) of the side d7-d12 to the length of the side d12-d10.

When the second passing-through time t1 output from the first mark sensor 31*a* corresponds to the side d6-d7 and the second passing-through time t3 output from the second mark sensor 31*b* to the length of the side d9-d10, $x:R/3=t1:(t3-t1)$ is obtained and thus $x=\{R/3\}\times t1)/(t3-t1)$ is obtained. Therefore, from the relationship: $x=(S+R/3)\times\beta$ and the relationship: $x=\{(R/3)\times t1)/(t3-t1)$, the relationship:

$$S=(R/3)\times\{t1/(t3-t1)\}-1\}\times\beta.$$

When the second passing-through time t1 output from the first mark sensor 31*a* is replaced with tc and the second passing-through time t3 output from the second mark sensor 31*b* is replaced with td, the relationship 3 is obtained.

Therefore, the CPU 21 of the control unit 20 can calculate the meandering amount S by the operation processing based on the relationship 3 using the two second passing-through times tc and td output from the mark sensor 31, the ratio β of expansion and contraction in the main scanning direction of the paper w, and the length R of the long side a1-a2 of the first mark portion 41*a*. The meandering amount S is a positive value (S>0) when the paper W meanders to the + side, a negative value (S<0) when the paper W meanders to the − side, and zero when the paper W does not meander as indicated by reversed arrows in FIG. 9.

The meandering amount S calculated as described above is valid when the value thereof is a third or less of the length of R of the long side a1-a2 of the first mark portion 41*a*.

A calculated meandering amount S which is greater than R/3 is not suitable as the meandering amount S calculated from the relationship 3. Therefore, by determining a meandering amount S that is calculated as a value that surpasses R/3 as invalid and a meandering amount S that is calculated as a value equal to or less than R/3 valid, the reliability of the calculation results is secured.

In addition, when the paper W meanders while the mark sensor 31 is detecting the mark 41, it is not possible to secure the accuracy of the meandering amount S obtained from the operation processing based on the relationship 3. Therefore, it is desirable to obtain an average of multiple meandering amounts S obtained by calculation every time the mark sensor 31 detects the mark 41 formed on the first side of the paper W and use it as the valid meandering amount. Therefore, the error ascribable to the meandering during the mark detection can be reduced.

The meandering amount S calculated as described above can be used as, for example, correction data in the meandering correction processing executed in the second printing apparatus 2. The meandering correction processing by which meandering in the main scanning direction of a long paper W is corrected is a known technology and thus not described here.

In addition, the ratio of expansion and contraction in the sub-scanning direction and the ratio of expansion and contraction in the main scanning direction can be used as data to align the position of the image formed on the second side of the paper W with the position of the image formed on the first side. That is, with regard to the sub-scanning direction of the paper W, the position of the image formed on the second side relative to the sub-scanning direction is aligned with the image formed on the first side by, for example, controlling the number of rotation of the transfer motor that transfers the paper W or the photoreceptor motor that rotates the image bearing member 27 to adjust the magnification ratio in the sub-scanning direction of the image formed on the second side of the paper W according to the calculated ratio of expansion and contraction in the sub-scanning direction. in addition, with regard to the main scanning direction of the paper W, the position of the image formed on the second side relative to the main scanning direction is aligned with the image formed on the first side by, for example, controlling the dot frequencies of the image formed on the second side of the paper W to adjust the magnification ratio in the main scanning direction of the image formed on the second side of the paper W according to the calculated ratio of expansion and contraction in the main scanning direction.

Referring to specific examples in detail as described above, in the printing system of the embodiment, the first printing apparatus 1 forms the mark 41 on the paper W and the second printing apparatus 2 detects the mark 41 by the mark sensor 31 to calculate the ratio of expansion and contraction in the sub-scanning direction and the ratio of expansion and contraction in the main scanning direction of the paper W. Therefore, when the paper W is expanded or contracted in not only the sub-scanning direction but also the main scanning direction by heat applied during image forming on the first side of the paper W by the first printing apparatus 1, the image positions of the first side and the second side of the paper W are suitably aligned by the calculated ratio of expansion and contraction in the sub-scanning direction and adjustment of the image formed on the second side of the paper W by the second printing apparatus 2 according to the calculated ratio of expansion and contraction in the sub-scanning direction.

In addition, the printing system related to this embodiment, the mark sensor 31 has two detection portions of the first mark sensor 31*a* and the second mark sensor 31*b* which are arranged to independently detect the mark 41 at two difference positions relative to the main scanning direction. Therefore, when the paper W meanders in the main scanning direction, the ratio of expansion and contraction in the main scanning direction is precisely calculated and the meandering amount can be calculated. That is, when images are formed on both sides of the long paper W, the paper W may be expanded or contracted in the sub-scanning direction and the main scanning direction of the paper W by heat applied during image forming on the first side and meanders simultaneously. In the printing system related to this embodiment, for any combination of expansion and contraction of the paper W in the sub-scanning direction, expansion and contraction of the paper W in the main scanning direction, and meandering of the paper W in the main scanning direction, each of the ratio of expansion and contraction in the sub-scanning direction, the ratio of expansion and contraction in the main scanning direction, and the meandering amount are suitably calculated. Therefore, in addition to the suitable alignment of the first side and the second side of the paper W, meandering of the paper W is suitably corrected so that the quality of the image formed on the first side and the second side are improved.

In addition, in the printing system related to this embodiment, there is no need to prepare separate marks for different uses because each of the ratio of expansion and contraction in the sub-scanning direction and the ratio of expansion and contraction in the main scanning direction caused by heat applied to the paper W and meandering in the main scanning direction caused by expansion and contraction of the paper W can be calculated by using a single mark, i.e. the mark 41. Therefore, the printing area of the paper W is enlarged and no meandering sensor to detect meandering of paper is necessitated so that an inexpensive printing system can be constructed.

In addition, according to the printing system related to this embodiment, the ratio of expansion and contraction in the sub-scanning direction can be calculated by a simple method (i.e., operation based on the relationship 1 of storing the first passing-through time (i.e., the time taken for the portion of the predetermined gap between the first mark portion 41*a* and the second mark portion 41*b* passing through the mark detection position) calculated in the state of the paper W free from expansion or contraction in a memory such as the RMA 22 as the first reference time and obtaining the ratio of the first passing-through time obtained in the state of the paper W having a contracted or expanded portion to the first reference time.

Furthermore, in the printing system related to this embodiment, the ratio of expansion and contraction in the main scanning direction free from the impact of meandering of the paper W and the meandering amount are obtained by easy geometric calculations by designing the mark 41 to have a right triangle. To be specific, the ratio of expansion and contraction in the main scanning direction is appropriately obtained while eliminating the impact of meandering of the paper W by the relationship 2 and the meandering amount of the paper W is also appropriately calculated by the relationship 3.

Moreover, in the printing system related to this embodiment which forms the mark 41 on the first side of the paper W such that the side along the main scanning direction of the first mark portion 41*a* is arranged at the position where an image formed on the first side of the paper W starts, the position of starting writing the image on the first side and the second side of the paper W can be aligned by adjusting the position of starting writing the image on the second side of the paper W based on the timing of detecting the side along the main scanning direction of the first mark portion 41*a*.

Second Embodiment

Next, the second embodiment is described. In the printing system related to this embodiment, a density sensor 50 to detect the density of the mark 41 is provided to the first printing apparatus 1 and the sensitivity of the mark sensor 31 of the second printing apparatus 2 is adjusted according to the density of the mark 41 detected by the density sensor 50.

Since the other structures of the second embodiment are the same as those of the first embodiment, detailed descriptions are mostly limited to the structure specific to the second embodiment while using the same reference numerals for the common portions of the first embodiment and the second embodiment.

Figure 10:
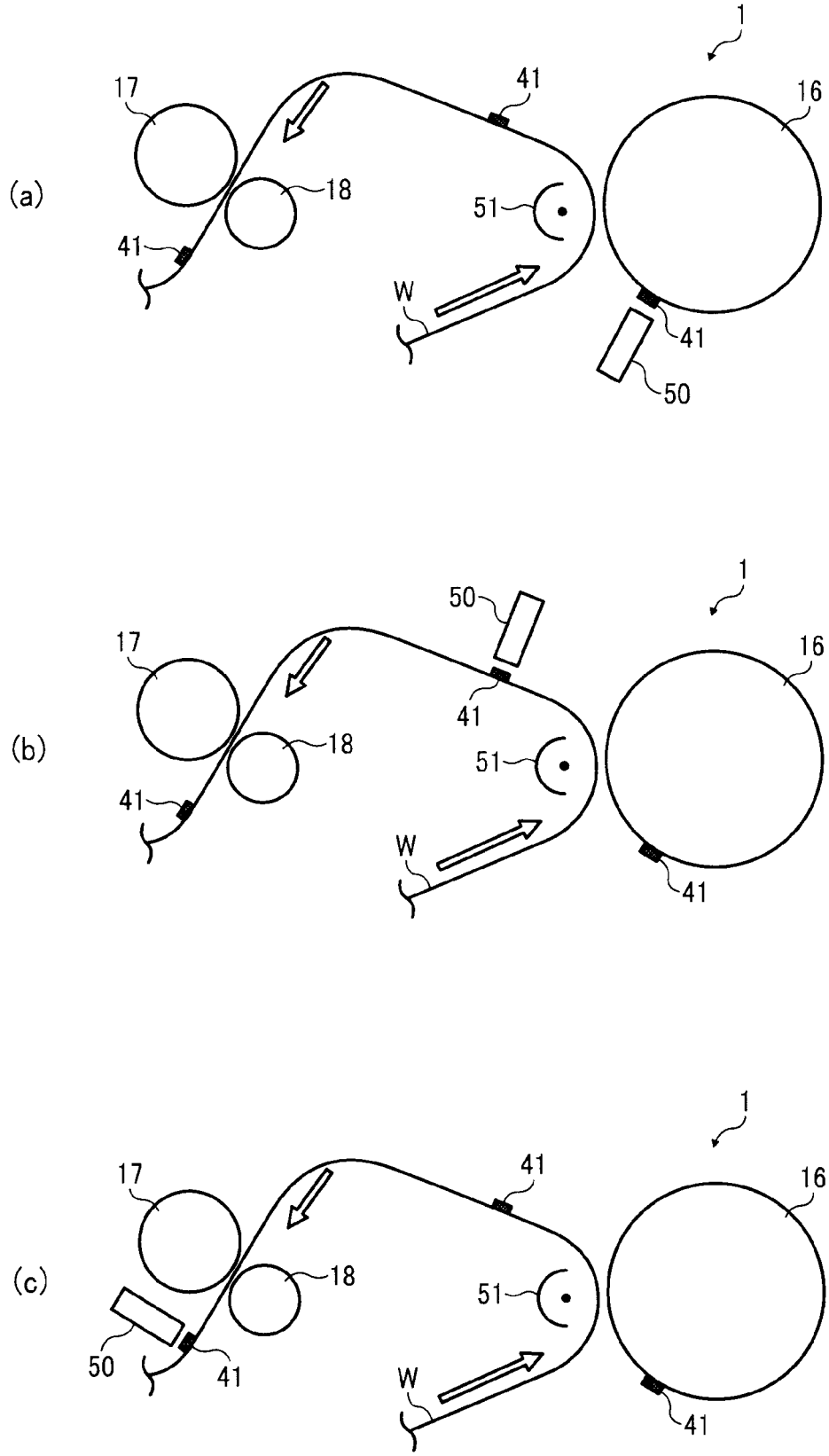
FIG. 10 is a diagram illustrating a specific example of the configuration of a density sensor of the first image forming apparatus.

FIG. 10 is a diagram illustrating a specific example of the arrangement of the density sensor 50 in the first printing apparatus 1. Reversed arrows in FIG. 10 indicate the conveyance direction of the paper W. In the printing system related to this embodiment, the density sensor 50 is provided to the first printing apparatus 1.

The density sensor 50 is to detect the density of the mark 41 formed on the first side of the paper W. A sensor having the same structure as the mark sensor 31 of the second printing apparatus 2 can be utilized as the density sensor 50. If a sensor having the same structure as the mark sensor 31 is utilized as the density sensor 50, the cost is reduced by the common use.

As described above, a toner image of the mark 41 formed on the image bearing member 16 is transferred to the first side of the paper W by a transfer device 51 and thereafter, the paper W is nipped and transferred by the pair of fixing rollers including the heating roller 17 and the pressing roller 18 while heating and pressing the paper W. Therefore, the toner image of the mark 41 is melted and fixed on the first side of the paper W. The density sensor 41 may be set to detect the density of the mark 41 at any stage of this process.

In the example illustrated in FIG. 10*a*, the density sensor 50 is arranged to face the periphery of the image bearing member 16. In this case, the density sensor 50 detects the density of the toner image of the mark 41 at a stage before it is transferred from the periphery of the image bearing member 16 to the first side of the paper W by the transfer device 51.

In the example illustrated in FIG. 10*b*, the density sensor 50 is arranged between the transfer device 51 and the fixing roller on the conveyance path of the paper W. In this case, the density sensor 50 detects the density of the toner image of the mark 41 at a stage between transferring of the toner image from the image bearing member 16 to the first side of the paper W and melting and fixing of it by the fixing roller.

As seen in this example, since the density of the toner image is detected after it is transferred from the first side of the paper W, the density obtained reflects the density change of the mark 41 that may be caused by transfer efficiency. Therefore, the density of the mark 41 is more precisely detected than in the example illustrated in FIG. 10*a*.

In the example illustrated in FIG. 10*c*, the density sensor 50 is arranged on the downstream side of the fixing roller on the conveyance path of the paper W. In this example, the density sensor 50 detects the density of the toner image of the mark 41 melted and fixed by the fixing roller.

As seen in this example, since the density of the toner image is detected after it is melted and fixed by the fixing roller, the density obtained reflects the density change of the mark 41 that maybe caused by fixing efficiency. Therefore, the density of the mark 41 is more precisely detected than in the example illustrated in FIG. 10*a* or 10*b*.

Figure 11:
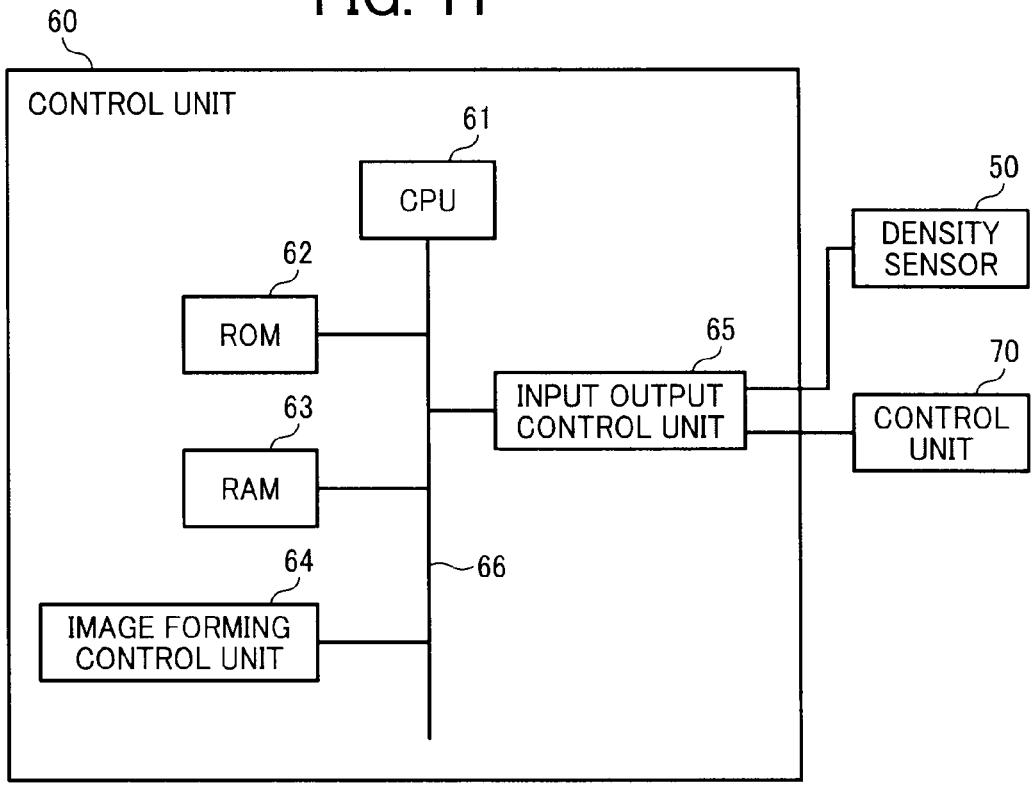
FIG. 11 is a block diagram illustrating the main structure of the control unit of the first image forming apparatus.

FIG. 11 is a block diagram illustrating the main portion of a control unit 60 of the first printing apparatus 1. In the printing system related to this embodiment, the first printing apparatus 1 has the control unit 60 illustrated in FIG. 11 in place of the control unit 10 of the first embodiment. The density of the mark 41 detected by the density sensor 50 is input into the control unit 60.

The control unit 60 of the first printing apparatus 1 has a CPU 61, a ROM 62, a RAM 63, an image forming control unit 64, and an input output control unit 65. The CPU 61, the ROM 62, the RAM 63, the image forming control unit 64, and the input output control unit 65 are connected by a system bus 66.

The CPU 61 is a central processing unit that controls the first printing apparatus 1 and performs various kinds of processing including forming the mark 41 on the first side of the paper W and transmitting the density of the mark 41 detected by the density sensor 50 to a control unit 70 of the second printing apparatus 2.

The ROM 62 is a read only memory that stores the programs executed by the CPU 61.

The RAM 63 is a random access memory used as a working area where the CPU 61 spreads out programs and executes various kinds of processing.

The image forming control unit 64 controls the image forming unit inside the first printing apparatus 1 based on the instructions from the CPU 61.

The input output control unit 65 receives the information of the density of the mark 41 output from the density sensor 50 and sends it to the CPU 61. The input output control unit 65 also sends the information of the density of the mark 41 detected by the density sensor 50 to the control unit 70 of the second printing apparatus 2 based on an instruction from the CPU 61.

Figure 12:
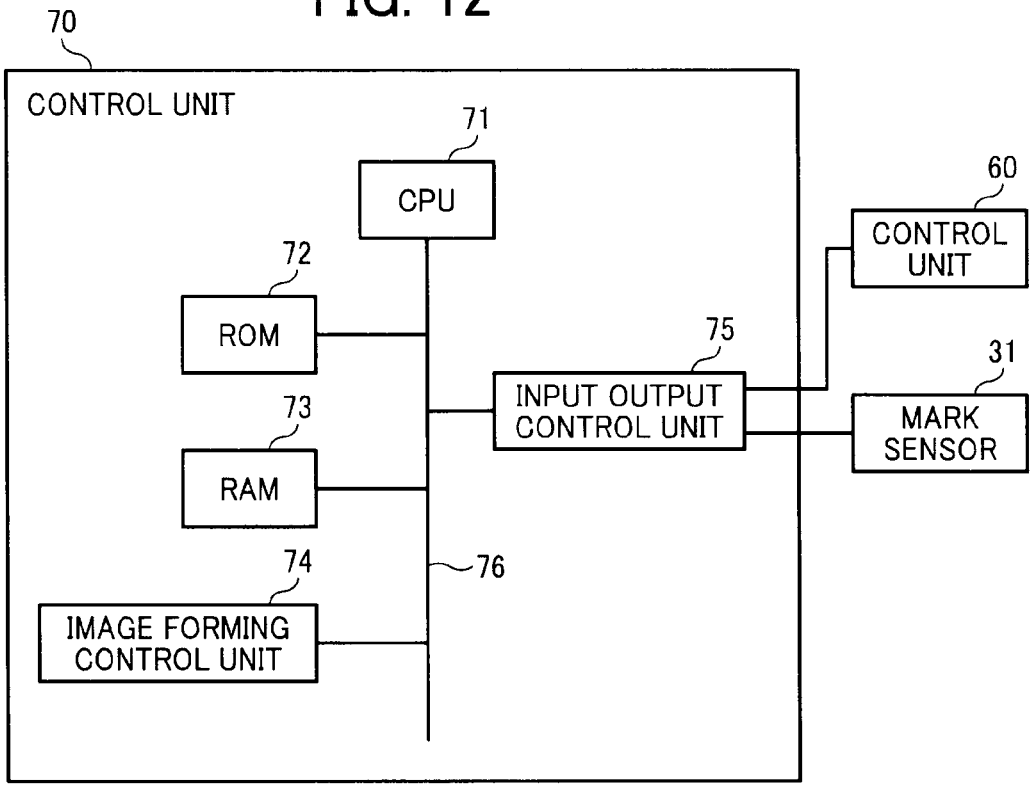
FIG. 12 is a block diagram illustrating an example of the main structure of the control unit of the second image forming apparatus.

FIG. 12 is a block diagram illustrating the main portion of a control unit 70 of the second printing apparatus 2. In the printing system related to this embodiment, the second printing apparatus 2 has the control unit 70 illustrated in FIG. 12 in place of the control unit 20 of the first embodiment.

The control unit 70 of the second printing apparatus 2 has a CPU 71, a ROM 72, a RAM 73, an image forming control unit 74, and an input output control unit 75 as illustrated in FIG. 12. The CPU 71, the ROM 72, the RAM 73, the image forming control unit 74, and the input output control unit 75 are connected by a system bus 76.

The CPU 71 is a central processing unit that controls the second printing apparatus 2 and executes various kinds of processing including adjusting the sensitivity of the mark sensor 31 based on the density of the mark 41, calculating the ratio of expansion and contraction in the sub-scanning direction and the ratio of expansion and contraction in the main scanning direction of the paper W (furthermore, the meandering amount if the mark sensor 31 has the first mark sensor 31*a* and the second mark sensor 31*b*) based on the first passing-through time and the second passing-through time input from the mark sensor 31, and adjusting the position of the image formed on the second side of the paper W according to the calculated ratio of expansion and contraction in the sub-scanning direction and the calculated ratio of expansion and contraction in the main scanning direction (i.e., shifting the image position by adjusting the timing of image forming).

The ROM 72 is a read only memory that stores the programs executed by the CPU 71.

The RAM 73 is a random access memory used as a working area where the CPU 71 spreads out programs and executes various kinds of processing.

The mage forming control unit 74 controls the image forming unit provided inside the second printing apparatus 1 based on instructions from the CPU 71.

The input output control unit 75 receives the information of the density of the mark 41 sent from the control unit 60 of the first printing apparatus 1 and sends it to the CPU 71. In addition, the input output control unit 75 receives a control signal from the CPU 71 to adjust the sensitivity of the mark sensor 31 and sends this control signal to the mark sensor 31. Furthermore, the input output control unit 75 receives the information of the first passing-through time and the second passing-through time output from the mark sensor 31 and sends it to the CPU 21.

In the second printing apparatus 2, for example, the sensitivity of the mark sensor 31 is adjusted based on the density of the mark 41 input from the control unit 60 of the first printing apparatus 1 by the CPU 71 of the control unit 70 executing the program recorded in the ROM 72. In this adjustment processing of the mark sensor 31, for example, the output sensitivity of the mark sensor 31 is increased by [$\times\alpha/\beta$] when the output of the density sensor 50 is $\beta$ [V] which is lower than the reference value $\alpha$ [V] (i.e., the density of the mark 41 is lower than the reference value). The CPU 71 of the control unit 70 adjusts the sensitivity of the mark sensor 31 according to the density of the mark 41 detected by the density sensor 50 by sending a control signal to adjust the sensitivity of the mark sensor 31 to the mark sensor 31 via the input output control unit 75. That is, in the second printing apparatus 2, the CPU 71 of the control unit 70 serves as a sensitivity adjustment device.

As described above, in the printing system relating to the embodiment, the density sensor 50 is used in the first printing apparatus 1 to detect the density of the mark 41 and the second printing apparatus 2 adjusts the sensitivity of the mark sensor 31 that detects the mark 41 according to the density of the mark 41 detected in the first printing apparatus 1. Therefore, in addition to the effect of the first embodiment, even if the density of the mark 41 formed on the first side of the paper W varies stemming from, for example, the density setting at image forming, fatigue of the image bearing member 16, and contraction and expansion of the paper W caused by heat, erroneous detection of the mark 41 can be effectively avoided.

In the printing system described above, the sensitivity of the mark sensor 31 is adjusted based on the density of the mark 41 detected by the density sensor 50. To the contrary, it is possible to adjust the density of the mark 41 formed by the first printing apparatus 1 in order for the mark sensor 31 to correctly detect the mark 41 using the output value of the mark sensor 31 as the reference value. Also in this case, the mark sensor 31 can correctly detect the mark 41 and erroneous detection of the mark 41 can be avoided. The density of the mark 41 can be adjusted by, for example, adjusting the amount of toner supplied to the image bearing member 16 by the development device or increasing or decreasing the power of the light source by the irradiation device.

As described above, embodiments of the present disclosure are specified in detail but the present disclosure is not limited thereto. That is, the structure and operation of the communication system related to the embodiments described above are for illustration purpose only and can be changed according to the objective and use.

For example, in the printing system of the embodiments described above, a job controller (e.g., print server) to control jobs to be executed by the first printing apparatus 1 and the second printing apparatus 2 may be provided. In this case, the job controller sets a suitable sequence and timing for execution about jobs received from a terminal of home computer, etc. and sends the jobs to the first printing apparatus 1 and the second printing apparatus 2 in that sequence and at the timing for execution. In addition, the job controller, the first printing apparatus 1, the second printing apparatus 2, and the terminal operated by a user are connected by Ethernet (trademark), USB (universal serial bus), or any communications device employing any format irrespective of wired or wireless.

In the embodiments described above, the printing system in which the printing apparatus employs electrophotography is described. In addition, a printing system using a printing apparatus employing another printing method such as ink jet method can calculate the ratio of expansion and contraction in the sub-scanning direction, the ratio of expansion and contraction in the main scanning direction, and the meandering amount, align the image positions on both sides of a paper based on the calculated values, and avoid erroneous detection of the mark by the mark sensor as in the case of the embodiment described above.

This document claims priority and contains subject matter related to Japanese Patent Applications nos. 2010-161524, 2010-243322, and 2011-122364 filed on Jul. 16, 2010, Oct. 29, 2010, and May 31, 2011, respectively, the entire contents of which are hereby incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming system comprising:

a first image forming apparatus to form an image on a first side of a recording medium, the first image forming apparatus comprising a mark forming device to form a mark having a first mark portion and a second mark portion on the recording medium, the first mark portion having a length variable in a first direction along a conveyance direction of the recording medium based on a position of the mark relative to a second direction perpendicular to the conveyance direction, the second mark portion having a line form parallel to one side of the first mark portion except for a side in parallel to the first direction, with a predetermined gap between the first mark portion and the second mark portion;

a reversing device to reverse the recording medium; and a second image forming apparatus to form an image on a second side that is the obverse of the first side, the second image forming apparatus comprising a mark detector to detect the mark formed by the mark forming device of the first image forming apparatus at a predetermined position along a conveyance path of the recording medium while the mark passes through the predetermined position and output a first passing-through time, representing a time taken for a portion of the predetermined gap between the first mark portion and the second mark portion to pass through the mark detection position, and a second passing-through time, representing a time taken for the first mark portion to pass through the predetermined position, and a calculator to calculate an expansion and contraction ratio of the recording medium in the first direction and an expansion and contraction ratio of the recording medium in the second direction based on the first passing-through time and the second passing-through time output by the mark detector, wherein the first image forming apparatus further comprises a density detector to detect a density of the mark and the second image forming apparatus further comprises a sensitivity adjustment device to adjust a sensitivity of the mark detector based on the density of the mark detected by the density detector.

2. The image forming system according to claim 1, wherein the mark detector comprises two detection portions to detect the mark at the predetermined position at two places which are different relative to the second direction and the calculator calculates the expansion and contraction ratio of the recording medium in the first direction, the expansion and contraction ratio of the recording medium in the second direction, and a meandering amount of the recording medium in the second direction based on the first passing-through time and the second passing-through time output by one of the two detection portions and the first passing-through time and the second passing-through time output by the other of the two detection portions.

3. The image forming system according to claim 1, further comprising an image adjusting device to align a position of the image formed on the second side with a position of the image formed on the first side by adjusting a scaling factor of the image formed on the second side in the first direction based on the expansion and contraction ratio of the recording medium in the first direction and a scaling factor of the image formed on the second side in the second direction based on the expansion and contraction ratio of the recording medium in the second direction.

4. The image forming system according to claim 1, further comprising a memory to store the first passing-through time obtained in a state in which the recording medium has no change in a length of the first direction as a reference time, wherein the calculator calculates the expansion and contraction ratio of the recording medium in the first direction as:

$$\alpha = ta/tb \qquad \text{Relationship 1}$$

where $\alpha$ represents the expansion and contraction ratio of the recording medium in the first direction, ta represents the first passing-through time, and tb represents the reference time.

5. The image forming system according to claim 4, wherein the first mark portion is a right triangle having a first side extending in the first direction, the first side being one of two sides other than the hypotenuse of the right triangle, and the other side of the two sides extending in the second direction.

6. The image forming system according to claim 2, wherein the two places are situated so as to trisect the second side of the first mark portion, and the calculator calculates the expansion and contraction ratio of the recording medium in the second direction as:

$$\beta = (1/3) \times \{\alpha \times (m/v)\}/(td - tc) \qquad \text{Relationship 2}$$

where $\beta$ represents the expansion and contraction ratio of the recording medium in the second direction, tc represents the second passing-through time output by one of the two detection portions, td represents the second passing-through time output by the other of the two detection portions, $\alpha$ represents the expansion and contraction ratio of the recording medium in the first direction, m represents a length of the first side of the first mark portion, and v represents a conveyance speed of the recording medium.

7. The image forming system according to claim 6, wherein the calculator calculates the meandering amount as:

$$S = R/3 \times [tc/(td - tc) - 1] \times \beta \qquad \text{Relationship 3}$$

where S represents the meandering amount and R represents a length of the second side of the first mark portion.

8. The image forming system according to claim 7, wherein the meandering amount S is valid only when the meandering amount is equal to or less than a third of the length of the second side of the first mark portion.

9. The image forming system according to claim 7, wherein the mark forming device forms the mark at multiple places of the first side and the calculator determines an average of meandering amounts calculated for the mark formed at the multiple places as the meandering amount.

10. The image forming system according to claim 5, wherein the mark forming device forms the mark such that the second side of the first mark portion is arranged at a writing starting position of the image formed on the first side, and the second image forming apparatus adjusts a position of starting writing the image formed on the second side based on a timing of the mark detector detecting the second side of the first mark portion.

11. The image forming system according to claim 1, wherein the mark forming device forms the mark by forming a toner image of the mark on an image bearing member, transferring the toner image to the first side, and melting and fixing the toner image thereon and the density detector detects the density of the toner image of the mark before the toner image is transferred to the first side.

12. The image forming system according to claim 1, wherein the mark forming device forms the mark by forming a toner image of the mark on an image bearing member, transferring the toner image to the first side, and melting and fixing the toner image thereon, and the density detector detects the density of the toner image of the mark after transferring of the toner image to the first side and before melting and fixing of the toner image thereon.

13. The image forming system according to claim 1, wherein the mark forming device forms the mark by forming a toner image of the mark on an image bearing member, transferring the toner image to the first side, and melting and fixing the toner image thereon, and the density detector detects the density of the toner image of the mark fixed on the first side.

14. The image forming system according to claim 1, further comprising a density adjustment device to adjust the density of the mark based on an output of the mark detector.

15. An image forming system comprising:

a first image forming apparatus to form an image on a first side of a recording medium, the first image forming apparatus comprising a mark forming device to form a mark having a first mark portion and a second mark portion on the recording medium, the first mark portion having a length variable in a first direction along a conveyance direction of the recording medium based on a position of the mark relative to a second direction perpendicular to the conveyance direction, the second mark portion having a line form parallel to one side of the first mark portion except for a side in parallel to the first direction, with a predetermined gap between the first mark portion and the second mark portion;

a reversing device to reverse the recording medium;

a second image forming apparatus to form an image on a second side that is the obverse of the first side, the second image forming apparatus comprising a mark detector to detect the mark formed by the mark forming device of the first image forming apparatus at a predetermined position along a conveyance path of the recording medium while the mark passes through the predetermined position and output a first passing-through time, representing a time taken for a portion of the predetermined gap between the first mark portion and the second mark portion to pass through the mark detection position, and a second passing-through time, representing a time taken for the first mark portion to pass through the predetermined position, and a calculator to calculate an expansion and contraction ratio of the recording medium in the first direction and an expansion and contraction ratio of the recording medium in the second direction based on the first passing-through time and the second passing-through time output by the mark detector; and a density adjustment device to adjust the density of the mark based on an output of the mark detector.

* * * * *